US010179637B2

(12) United States Patent
Miller, Jr. et al.

(10) Patent No.: US 10,179,637 B2
(45) **Date of Patent: *Jan. 15, 2019**

(54) TURBULENCE ENHANCER FOR KEEL COOLER

(71) Applicant: Duramax Marine, LLC, Hiram, OH (US)

(72) Inventors: P. Charles Miller, Jr., Bonita Springs, FL (US); Frank E. Horvat, Macedonia, OH (US)

(73) Assignee: Duramax Marine, LLC, Hiram, OH (US)

( * ) Notice: Subject to any disclaimer, the term of this patent is extended or adjusted under 35 U.S.C. 154(b) by 590 days.

This patent is subject to a terminal disclaimer.

(21) Appl. No.: 14/663,044

(22) Filed: Mar. 19, 2015

(65) Prior Publication Data

US 2015/0191237 A1 Jul. 9, 2015

Related U.S. Application Data

(63) Continuation of application No. 14/508,091, filed on Oct. 7, 2014, which is a continuation of application No. PCT/US2014/027440, filed on Mar. 14, 2014.

(Continued)

(51) Int. Cl.
*B63H 21/38* (2006.01)
*F28F 13/02* (2006.01)

(Continued)

(52) U.S. Cl.
CPC ..... *B63H 21/383* (2013.01); *F28D 1/022* (2013.01); *F28D 1/05366* (2013.01);

(Continued)

(58) Field of Classification Search
CPC .. B63H 21/10; B63H 21/383; B63B 2770/00; F28F 13/06; F28F 13/12; F28F 1/40;

(Continued)

(56) References Cited

U.S. PATENT DOCUMENTS 166,461 A 8/1875 Houghton
521,476 A 6/1894 Reader (Continued)

FOREIGN PATENT DOCUMENTS

CN 1651847 A 8/2005
JP 60-086389 10/1983

(Continued)

*Primary Examiner* — Len Tran
*Assistant Examiner* — Hans Weiland
(74) *Attorney, Agent, or Firm* — Walter | Haverfield LLP; D. Peter Hochberg; Sean F. Mellino

(57) ABSTRACT

A keel cooler assembly comprising a coolant tube including a plurality of turbulence enhancers for improving the heat transfer of the coolant without substantially increasing pressure drop of the coolant. In one embodiment, the turbulence enhancers are provided for generating turbulent wakes in the coolant for disrupting laminar boundary layers for improving heat transfer. In another embodiment, the turbulence enhancers are provided for generating and propagating turbulent vortexes in the coolant to enhance mixing of the bulk coolant for improving heat transfer. In other embodiments, turbulators, including inserts or impediments, are provided having various configurations and being arranged in predetermined patterns for enhancing turbulence of the coolant for improving keel cooler heat transfer efficiency without substantially increasing pressure drop.

59 Claims, 19 Drawing Sheets

Related U.S. Application Data

(60) Provisional application No. 61/784,977, filed on Mar. 14, 2013.

(51) Int. Cl.
*F28D 1/02* (2006.01)
*F28D 1/053* (2006.01)
*F28F 13/12* (2006.01)
*F28F 13/06* (2006.01)

(52) U.S. Cl.
CPC ..... *F28D 1/05375* (2013.01); *F28F 13/06* (2013.01); *F28F 13/12* (2013.01)

(58) Field of Classification Search
CPC ... F28F 1/42; F28F 1/422; F28F 3/022; F28D 1/02; F28D 1/0206; F28D 1/022; F28D 1/0535; F28D 1/05366; F15D 1/002; F15D 1/003; F15D 1/035; F15D 1/0045; F15D 1/06; F15D 1/065
See application file for complete search history.

(56) References Cited

U.S. PATENT DOCUMENTS 1,947,606 A 2/1934 Lonergan
2,004,252 A 6/1935 Sorensen
2,382,218 A 8/1945 Fernstrum
2,488,615 A * 11/1949 Arnold ..... F28F 13/12 138/38
2,872,164 A 2/1959 Wilson
2,873,354 A 2/1959 Shoup
2,874,943 A 2/1959 Fennell
2,892,618 A 6/1959 Holm
3,177,936 A 4/1965 Walter
3,240,179 A 3/1966 Van Rast
3,302,701 A 2/1967 Thomas
3,650,310 A 3/1972 Childress
3,841,396 A 10/1974 Knaebel et al.
3,981,356 A 9/1976 Granetzke
4,043,289 A 8/1977 Walter
4,200,149 A * 4/1980 Pechner ..... F28F 13/12 123/41.33
4,200,194 A 4/1980 Zeischegg et al.
4,336,838 A 6/1982 Ely
4,470,452 A 9/1984 Rhodes
4,691,766 A 9/1987 Wurz et al.
4,692,030 A 9/1987 Tauscher et al.
4,758,098 A 7/1988 Meyer
4,823,865 A 4/1989 Hughes
4,865,460 A 9/1989 Friedrich
5,070,937 A 12/1991 Mougin et al.
RE34,255 E 5/1993 Friedrich
5,361,828 A 11/1994 Lee et al.
5,730,213 A * 3/1998 Kiser ..... F28D 1/05383 165/109.1
5,800,059 A 9/1998 Cooke et al.
5,845,399 A * 12/1998 Dewar ..... F28D 9/0062 165/166
6,203,188 B1 3/2001 Maurer et al.
6,279,611 B2 8/2001 Uematsu et al.
6,575,227 B1 * 6/2003 Leeson ..... F28D 1/05366 165/173
6,578,627 B1 6/2003 Liu et al.
6,896,037 B2 * 5/2005 Leeson ..... F28D 1/05366 165/173
7,044,194 B2 5/2006 Leeson et al.
7,055,576 B2 6/2006 Fernstrum
7,328,740 B2 2/2008 Leeson et al.
7,637,720 B1 12/2009 Liang
7,942,137 B2 5/2011 Geskes et al.
2001/0018970 A1 9/2001 Nakado et al.
2001/0052411 A1 * 12/2001 Pantow ..... F28D 1/05366 165/152
2003/0015316 A1 1/2003 Burkay
2006/0201652 A1 9/2006 Leeson et al.
2009/0025916 A1 1/2009 Meshenky et al.
2009/0294113 A1 * 12/2009 Cha ..... F28D 9/0037 165/185
2010/0170667 A1 * 7/2010 Bertolotti ..... F28F 1/124 165/166
2010/0212872 A1 8/2010 Carlson
2010/0265792 A1 10/2010 Krumboeck
2012/0180991 A1 * 7/2012 Viswanathan ..... F28F 1/40 165/104.14

FOREIGN PATENT DOCUMENTS

JP 62-019696 7/1985
JP 62-113000 11/1985

* cited by examiner

TURBULENCE ENHANCER FOR KEEL COOLER

CROSS-REFERENCE TO RELATED APPLICATIONS

This application is a continuation of U.S. patent application Ser. No. 14/508,091 filed Oct. 7, 2014, which is a continuation of International Application No. PCT/US2014/027440, filed Mar. 14, 2014, which claims priority to U.S. Provisional Application Ser. No. 61/784,977, filed Mar. 14, 2013, all of which are incorporated herein by reference in their entireties.

BACKGROUND OF THE INVENTION

Field of the Invention

This invention relates to the improvement of heat transfer in a marine keel cooler, and in particular to improving heat transfer of the internal coolant flowing through keel cooler coolant tubes.

Discussion of the Prior Art

Heat-generating sources in marine vessels are often cooled by water, other fluids, or water mixed with other fluids. In marine vessels, cooling fluid or coolant flows through the engine or other heat generating source where the coolant picks up heat and then flows to another part of the plumbing circuit. The heat must be transferred from the coolant to the ambient surroundings, such as the body of water in which the vessel is located. For small vessels having outboard motors, the raw ambient water being pumped through the engine is a sufficient coolant. However, as the vessel power demand gets larger, ambient water pumped through the engine serves as a source of significant contamination damage, particularly if the ambient water is corrosive salt water and/or carries abrasive debris.

There have been developed various apparatuses for cooling engines and other heat sources of marine vessels. One such apparatus that uses coolant in a closed-loop plumbing circuit is a keel cooler. Keel coolers were developed more than 70 years ago for attachment to a marine hull structure, an example of which is described in U.S. Pat. No. 2,382,218 (Fernstrum). A keel cooler is basically composed of a pair of spaced headers secured to the hull and separated by a plurality of heat conduction or coolant tubes. In the plumbing circuit of a vessel, hot coolant flows from the engine and into the keel cooler header located beneath the water level (i.e., below the aerated water level), and then into the coolant tubes. The coolant flows through the coolant tubes to the opposite header, and the cooled coolant returns through the plumbing circuit to the engine. The headers and coolant tubes disposed in the ambient water operate to transfer heat from the coolant, through the walls of the coolant tubes and headers, and into the ambient water. The foregoing type of keel cooler is referred to as a one-piece keel cooler, since it is an integral unit with its major components being welded or brazed in place. However, other types of keel coolers are known, including demountable keel coolers having spiral tube configurations wherein the major components, including coolant tubes, are detachable An important aspect of a keel cooler is the ability to efficiently transfer heat from the coolant flowing through the inside of the coolant tubes into the cooler ambient water around the outside. There are several factors that impact keel cooler heat transfer, one of which is the rate at which the heat flows into, or out from, either the interior fluid (i.e., coolant) or exterior fluid (i.e., ambient water). A high resistance to heat flow in either fluid will produce a slow overall rate of heat transfer. For the coolant, the inside heat transfer ($H_i$) is a function of coolant thermal properties, inside tube geometry, coolant flow rate, coolant flow distribution per tube, coolant flow characteristics (i.e., laminar or turbulent), and inside wall friction coefficients. For the ambient water, the outside heat transfer ($H_o$) is a function of outside fluid thermal properties, outside tube/keel cooler geometry, flow characteristics and restrictions, tube assembly, location on the hull, and speed and direction of ambient water passing over the keel cooler. Other factors to consider in overall heat transfer include the coolant tube wall thickness and the thermal conductivity of the tube material.

One known way to improve overall heat transfer is to increase the effective area of the keel cooler in order to increase the conductive barrier provided for heat flow. In other words, a larger keel cooler area will result in a greater amount of heat that will flow in a given time with a given temperature differential. Keel coolers are usually disposed in recesses at the bottom of the hull of the vessel, and sometimes are mounted on the side of the vessel, but always below the water line. The area on the vessel hull which is used to accommodate a keel cooler is referred to as the "footprint." However, an important aspect of keel coolers for marine vessels is the requirement that they have as small a footprint as possible, while fulfilling or exceeding their heat exchange requirement and minimizing pressure drops in coolant flow. As such, keel coolers in the prior art have minimized their footprint by utilizing rectangular tubes and spacing them relatively close to each other to create a large heat flow surface area. Accordingly, keel coolers in the prior art often have a total of eight rectangular coolant tubes extending between the two headers, including six intermediate tubes and two outer-side tubes, which usually have cross-sectional dimensions of either 1.375 in.×0.218 in., 1.562 in.×0.375 in., or 2.375 in.×0.375 in. However, demands for improving engine fuel efficiency and payload capacity of vessels have resulted in higher engine output temperatures and a greater demand on keel cooler heat transfer efficiency, and since the keel cooler must maintain as small a footprint as possible, there exists a need to improve the heat transfer efficiency of the keel cooler in other ways.

Another way to improve keel cooler heat transfer is to enhance the flow rate and flow distribution of the internal coolant. It is well known that the flow rate of the coolant flowing through the coolant tubes has a velocity upon which the heat transfer is partially dependent. Moreover, it is also well known in the keel cooler art that the two outer-side tubes have the greatest area of exposure to the external ambient water, and that increasing flow distribution to these outer tubes would also improve keel cooler efficiency. However, keel coolers with rectangular headers and rectangular heat conduction tubes may provide imbalanced coolant flow among the parallel tubes, which can lead to both excessive pressure drops and inferior heat transfer. In particular, coolant flowing through the heat exchanger may have limited access to the outer-side tubes even in the presence of orifices designed for passing coolant to these outer-side tubes. As such, the vast majority of keel cooler developments in the past 15 years have focused on improving heat transfer efficiency by enhancing as well as equalizing the flow rate through the side tubes and intermediate tubes. For example, U.S. Pat. No. 6,575,227 (having the same assignee as the present application) was directed toward a keel cooler having a beveled bottom wall with outer-side tube orifices being in the natural flow path of coolant flow for improving flow rate and flow distribution to the coolant tubes. U.S. Pat. No. 6,896,037 (also having the same assignee) additionally provided in the header a fluid flow diverter for facilitating coolant flow towards both the inner tubes and the outer-side tubes. U.S. Pat. No. 7,055,576 (Fernstrum) was directed toward an apparatus for enhancing keel cooler efficiency by increasing the flow rate of coolant through side tubes by using apertures in an arrow-shaped design. However, as already mentioned, the demand on keel cooler efficiency continues to increase, and there exists a need for a new development in the art of keel coolers, which is satisfied by the present invention.

An approach for improving keel cooler heat transfer that has received no attention in the prior art is through the enhancement of turbulent flow of the internal coolant flowing through coolant tubes. In most modern keel cooler designs, the rectangular coolant tubes have a relatively smooth inner surface that promotes laminar flow of the cooling fluid at or near the coolant tube interior walls. Laminar flow is defined as a flow condition where a viscous fluid flows in contact with a tube surface at a low velocity so as not to produce any intermixing of the fluid. In a laminar flow regime, the fluid in contact with the tube wall will have its velocity reduced by viscous drag or friction, which produces a "boundary layer" that acts as a region of high viscous shear stress. This viscous shear layer, or boundary layer, acts to retard the passage of fluid along the pipe through the no-slip condition at the wall. Within the boundary layer, these viscous, frictional stresses cause energy dissipation into the bulk fluid, which appears as heat. In other words, the boundary layer not only inhibits mixing in the bulk fluid, but also acts as an insulative heat generating layer at the coolant tube interior wall (i.e., the heat transfer surface), therefore reducing the overall heat transfer of the keel cooler.

On the other hand, enhancing turbulence within the coolant can help to minimize the thermally resistant boundary layer. Turbulence is generally defined as the flow regime in which the fluid exhibits chaotic property changes, such as rapid fluctuations in velocity and pressure of the fluid about some mean value. Whether fluid flow will result in laminar or turbulent flow is primarily determined by the Reynolds number, which may be defined as the ratio between the inertial force and viscous force of the fluid. As such, the Reynolds number is a function of the fluid velocity, and as fluid velocity increases, a transition region can be reached in which the inertial forces dominate over the viscous forces. This may allow for the development of turbulent eddies in the fluid which can impact and destroy the boundary layer, resulting in a decrease in boundary layer thickness. As turbulence is further increased, eddying motion can become increasingly unsteady, causing the eddies to burst from the wall and mix with the bulk fluid (i.e., the region of fluid outside of the boundary layer that is further from the tube wall). The turbulent eddies that are formed can transport large quantities of thermal energy. Therefore, heat transfer can be increased where the eddies bursting from and/or impacting the tube wall act to disrupt or destroy the boundary layer insulation and take large amounts of cooler fluid from the wall and distribute it into the hotter bulk fluid regions.

While the science behind turbulence is not considered a well-understood art, it is generally believed that increasing turbulent flow inside of a keel cooler tube will result in an increase in the pressure drop of the coolant. This is believed to be caused by the turbulent eddies of various sizes interacting with each other as they move around, exchanging momentum and energy, and consuming the fluid's mechanical energy as the bulk fluid is forced to drive these unsteady eddy motions. In other words, in the keel cooler art, it is believed that enhancing turbulence will result in increased drag and pressure drop due to the increased transverse motion of fluid particles that oppose the direction of bulk fluid flow. In the keel cooler art, increasing system pressure drop is considered devastating to keel cooler performance and detracts from the overall usefulness of the keel cooler. This is because keel coolers on marine vessels are generally limited by the pumping capacity of the marine motor and do not usually have external pumps that can compensate for increased pressure drop. In other words, unlike land-based heat exchanger systems that can accommodate larger footprints with external pumps, keel coolers have strict size and payload constraints that practically preclude the use of an external pump. It is for this reason that developments in the keel cooler art have traditionally avoided enhancing coolant turbulence, for concerns over increasing pressure drop.

The only known keel cooler on the market that allegedly attempts to disrupt the coolant flow pattern inside of a rectangular keel cooler tube is an apparatus having a plurality of roughness elements on the interior surface of the coolant tube. The roughness elements of this known apparatus are small protrusions in the form of bumps arranged on the coolant tube interior wall. The bumps of this apparatus are about 0.015 inches in height, with a diameter of 0.022 inches, and spaced evenly by 0.060 inches in a staggered configuration. It is believed that the purpose of these roughness elements is to disrupt the boundary layer insulation at the coolant tube interior wall. However, it is well known in the keel cooler industry that this apparatus significantly increases pressure drop with de minimus improvement in heat transfer. Therefore, it is believed that this device does not enhance turbulent coolant flow and/or generate unsteady eddying motions as to effectively mix the bulk coolant to improve heat transfer. Instead, this apparatus acts to increase surface roughness of the coolant tube wall, which increases the friction factor according to the well-known Moody diagram, and therefore results in the observed increase in pressure drop. The introduction of this apparatus into the keel cooler market has only further detracted those skilled in the art from pursuing coolant flow characteristics as an avenue for successfully increasing heat transfer.

As it generally pertains to keel cooler heat transfer, there are known keel coolers of only general interest that use external fins to improve the outside heat transfer ($H_o$) with the ambient water. For example, U.S. Pat. No. 3,841,396 (Knaebel) provides for a marine vessel heat exchanger having a series of radially extending external fins connected to a longitudinal member. The Knaebel invention provides these external fins to increase the surface area of the heat exchanger and does not teach turbulent flow to improve internal heat transfer ($H_i$). In U.S. Pat. No. 3,240,179 (Van Ranst), a marine heat exchanger is disclosed providing a bottom sheet portion in a transverse sinuous configuration. The Van Ranst invention is intended to provide a relatively large effective heat exchange area in proportion to the complete unit. The Van Ranst invention further provides for a smooth flow path of the inner coolant fluid, which is described as "optimal" and is believed to teach away from promoting turbulent fluid flow. In U.S. Pat. No. 3,650,310 (Childress), a combination boat trim tab and heat exchanger is provided having elongated fins secured to the bottom of the outside of the body to increase heat exchange area. Childress further provides an internal serpentine passageway and internal cooling fins to further increase the heat exchange area between the cooling liquid and the body. The invention in Childress does not disclose the use of turbulent coolant flow to increase heat transfer. U.S. Pat. No. 3,177,936 (Walter) provides a marine heat exchanger that includes a fluted heat exchange tube with an internal helical baffle. The fluted tube of the Walter invention is intended to increase heat exchange surface area, as well as improve the flow of external seawater over the tubes. The helical baffle in the Walter invention is intended to mechanically agitate the coolant and to partition the tubes into at least two stream passages of a serpentine form. The Walter invention does not disclose promoting turbulent flow of the coolant, as this term was well known in the art at the time of that invention. More particularly, Walter does not teach enhancing turbulence through naturally occurring eddying motions to improve bulk fluid mixing, and instead merely mechanically agitates the coolant to some unknown degree. Moreover, such partitioning inside of the coolant tube is believed to restrict coolant flow, which would result in a substantial increase in pressure drop compared to a similarly situated tube without the flutes and baffle. Therefore, as can be seen by these shortcomings in the keel cooler prior art, there exists a need to further improve heat transfer without increasing pressure drop, which can be achieved by the present invention through the provision of turbulence enhancers for use in the internal coolant.

Turbulators, which are known as inserts, tube inserts, impediments, or static mixers, are known to be arranged inside of a tube in order to promote and/or enhance turbulent fluid flow. Although turbulators are known to enhance turbulence and promote bulk fluid mixing to improve heat transfer, they are also known to detrimentally increase pressure drop. Because those skilled in the keel cooler art have been taught to avoid increased pressure drop due to the pumping constraints of marine motors, the use and teachings of turbulators have generally been confined to land-based heat exchanger systems where pressure loss can be compensated by external pumping means. Moreover, the relatively slow rate of innovation in the keel cooler art, combined with the lack of understanding of turbulence, has only further detracted those persons with ordinary skill in the keel cooler art from logically commending their attention to other heat exchanger systems.

Accordingly, there have been various patents of only general interest pertaining to turbulators which have issued over the years. U.S. Pat. No. 3,981,356 (Granetzke) describes a heat-exchange tube with a strip of expanded metal arranged in a helix to form a turbulator. This arrangement is alleged to direct a portion of the liquid toward the inner wall surface to control heat flow, however, it also results in increased pressure drop. The Granetzke invention alleges to regulate this increase in pressure drop by modifying the expanded metal configuration. Referring next to U.S. Pat. No. 6,578,627 (Liu et al.), this patent discloses a fin-pattern of ribbed vortex generators for an air conditioner system having a plurality of prism-like structures on the fin. The structures have different heights for improving heat transfer while allegedly causing little pressure drop-off. Similarly, U.S. Pat. No. 7,637,720 (Liang) provides a turbulator for use with a turbine blade of a gas turbine engine having an inverted V-shape with a diffusion slot between adjacent turbulators. In U.S. Pat. No. 4,865,460 (Friedrich), a static mixing device is disclosed having a plurality of rows of spaced parallel tubes extending across the conduit. The tubes are arranged so that adjacent tubes are located at right angles to each other, which provides a tortuous path for the viscous resin medium to be mixed. The Friedrich invention requires the product to be fed through the tortuous path of the static mixer at "high pressure," and does not disclose the effect of pressure loss.

In light of the foregoing, it should be understood that keel coolers with the smallest footprint, greatest overall heat transfer, and least internal pressure drop are considered the most desirable. However, despite the various efforts to enhance turbulence and increase heat transfer using turbulators in general heat exchangers, there has been no known development in this area with respect to marine keel coolers. The demand on keel cooler efficiency is increasing as marine motors must become more efficient and carry heavier payloads. If turbulence enhancers can be selected to increase heat transfer while not substantially increasing pressure drop to an unacceptable level, there could be significant economic savings in the keel cooler industry. Therefore, there exists a long-felt, yet unsatisfied need for a keel cooler that improves heat transfer by enhancing turbulent coolant flow inside of the coolant tubes without a substantial increase in pressure drop. Such a keel cooler with improved heat transfer could further reduce the size required of the keel cooler, the cost of acquiring keel coolers, and the manufacturing costs associated with keel coolers.

SUMMARY OF THE INVENTION

The present invention satisfies the various long-felt, yet unsatisfied needs in the keel cooler art through the provision of a keel cooler assembly comprising a header and at least one coolant tube, which includes a means for enhancing the turbulence of the coolant for improving heat transfer without substantially increasing pressure drop of the coolant, and also without increasing the footprint of the keel cooler. The header may comprise an upper wall, an end wall, a bottom wall, opposing sidewalls, and an inclined surface operatively connecting upper wall, bottom wall and sidewalls, and also having spaces to receive each inner coolant tube. Each coolant tube may extend in a longitudinal direction from the header and comprises an elongated body portion including an interior surface forming an internal channel for allowing flow of the coolant, and also configured for enhancing turbulence. Each coolant tube may have at least one inlet for ingress of the coolant and at least one outlet for egress of the coolant. In some preferred embodiments there may be eight or more of these coolant tubes.

Another aspect of the invention relates to a provision wherein means for enhancing turbulence comprises a means for generating turbulent wakes in the coolant for increasing eddying motion and for improving heat transfer without substantially increasing pressure drop. In a preferred embodiment, means for generating turbulent wakes is provided in the bulk region of the coolant, the bulk region being the region of fluid outside of the boundary layer that is further from the coolant tube wall.

Yet another aspect of the invention is a provision wherein means for enhancing turbulence comprises a means for generating and propagating turbulent vortexes in the coolant for enhancing bulk coolant mixing for improving heat transfer without substantially increasing pressure drop.

Still another aspect of the invention is to achieve the foregoing means through the provision of a plurality of turbulence enhancers extending inwardly into the coolant tube internal channel from the coolant tube interior surface and being arranged in a predetermined pattern. Turbulence enhancers may be provided through the provision of turbulators having various configurations. Turbulators may be provided as inserts, such as cylindrical inserts with round, ellipsoid, or oval cross sections; hollow inserts, such as inserts with interior channels; inserts in the form of a rectangular parallelepiped, such as with square or rectangular cross sections; pyramidal inserts, such as with triangular cross sections; flat bars; bars having a wing-shaped configuration; inserts with polygonal configurations; inserts having one or more rounded surfaces; inserts having a configuration with combined rounded and flat surfaces; or any variety of inserts having irregular cross sections. The invention is not limited to having inserts as turbulators and could, for example, comprise coolant tubes with walls having internal turbulators as an integral part of the respective walls.

Another aspect of turbulence enhancers according to embodiments of the invention is through the provision of turbulators as impediments to coolant flow. Such impediments could be, amongst others, pins of various configurations, impediments sloped as chevrons, vane configurations having tear drop-shaped cross sections, impediments with or without orifices, impediments having undulating shapes, impediments having star-shaped cross sections, and the like. The impediment(s) could extend from the interior wall surface part-way into the coolant tube interior, or could extend into and be attached to two or more attachment points in the tube interior. In some situations, the impediment(s) could extend longitudinally in the respective tubes and may not be attached to coolant tube interior surface.

The invention further relates to the dimensions of the turbulators for respective sizes and shapes of the keel cooler tube in which turbulators are to be placed.

Another aspect of the invention is the distance between the respective turbulators in a keel cooler tube, the position of each turbulator in a keel cooler tube, the spacing between turbulators, and the pattern of turbulators in a keel cooler tube—all for increasing heat transfer while minimizing increase in pressure drop of the coolant, and while not unreasonably increasing the footprint of the keel cooler.

The foregoing turbulators could face in different directions inside the keel cooler tube, depending on the nature of the coolant, the shape and size of the keel cooler tube, the pressure of the coolant, amongst other factors.

Another aspect of the invention relates to the provision of a coolant tube for a keel cooler comprising an elongated body portion having an interior surface forming an internal channel and comprising a plurality of turbulators extending from the interior surface. The turbulators are configured to interact with the coolant for enhancing turbulence to improve heat transfer without substantially increasing pressure drop, and potentially to result in a decrease in the footprint of the keel cooler of which coolant tube constitutes a component. In a preferred embodiment, the respective coolant tubes have a rectangular cross section, which may include cross-sectional dimensions common to the industry. The coolant tube may be a keel cooler inner coolant tube or an outer coolant tube and may have various inlets and/or outlets depending on the particular configuration.

Through the provisions and embodiments discussed herein, it is a general object of the invention to increase the heat transfer in a keel cooler while minimizing any increase of the pressure drop of the coolant flowing through the keel cooler.

Another object of the invention is to enhance the turbulence of coolant flowing through keel cooler tubes while not substantially increasing the pressure drop of the coolant. Yet another object of the invention is to naturally generate turbulent wakes in the coolant; and further still, an object is to generate turbulent vortexes in the coolant, all while not substantially increasing pressure drop. In preferred embodiments, an object of the invention is to generate turbulent wakes and/or turbulent vortexes through naturally occurring eddy motions in the bulk region of the coolant without substantially increasing pressure drop.

Another object of the invention is to enhance turbulence for improving heat transfer independent of the bulk fluid velocity or flow rate. In a preferred embodiment, turbulence is enhanced and heat transfer improved without substantial pressure drop even when coolant tube interior walls are substantially smooth between respective turbulence enhancers.

It is yet another object of the present invention to provide a turbulence enhancer for a keel cooler tube for increasing the heat transfer capability of the keel cooler.

It is an additional object of the invention to enhance the turbulence inside a keel cooler tube to increase the heat transfer capability of the keel cooler, to thereby decrease the size of the footprint of the keel cooler to therefore reduce costs for the vessel owner where the keel cooler is to be incorporated.

A general object of the present invention is to increase the efficiency and effectiveness of keel coolers in an economical and practical manner.

These and other objects should be apparent from the description to follow and from the appended claims.

BRIEF DESCRIPTION OF THE DRAWINGS

The present invention may take physical form in certain parts and arrangement of parts, the preferred embodiments of which will be described in detail in the specification and illustrated in the accompanying drawings which form a part hereof, and wherein.

DESCRIPTION OF THE PREFERRED EMBODIMENTS

Figure 1:
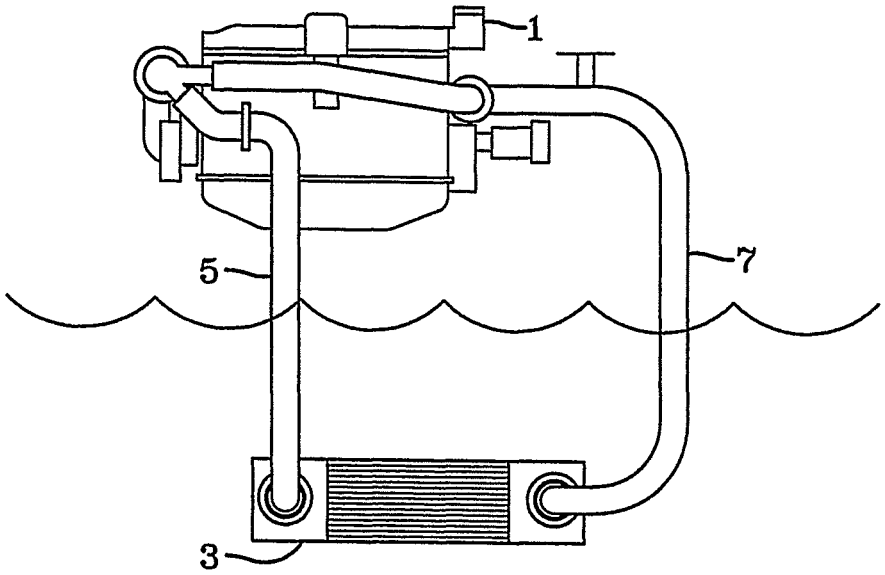
FIG-1 PRIOR ART
FIG. 1 is a schematic view of a keel cooler on a vessel in the water according to the prior art.

The fundamental components of a keel cooler system for a water-going or marine vessel are shown in FIG. 1. The system includes a heat source 1, a keel cooler 3, a pipe 5 for conveying the hot coolant from heat source 1 to keel cooler 3, and a pipe 7 for conveying cooled coolant from keel cooler 3 to heat source 1. As shown in FIG. 1, keel cooler 3 is located in the ambient water below the water line (i.e. below the aerated water line where foam and bubbles occur), and heat from the hot coolant is transferred through the walls of keel cooler 3 and expelled into the cooler ambient water. Heat source 1 could be an engine, a generator, or other heat source for the vessel. Keel cooler 3 could be a one-piece keel cooler, however, the present invention is not limited to one-piece keel cooler systems and may include demountable keel cooler systems having detachable parts (such as spiral coolant tubes), or even channel steel heat exchanger systems that are welded to the hull to form an enclosed channel in which the coolant is ported through the hull and flows through the channel.

Figure 2:
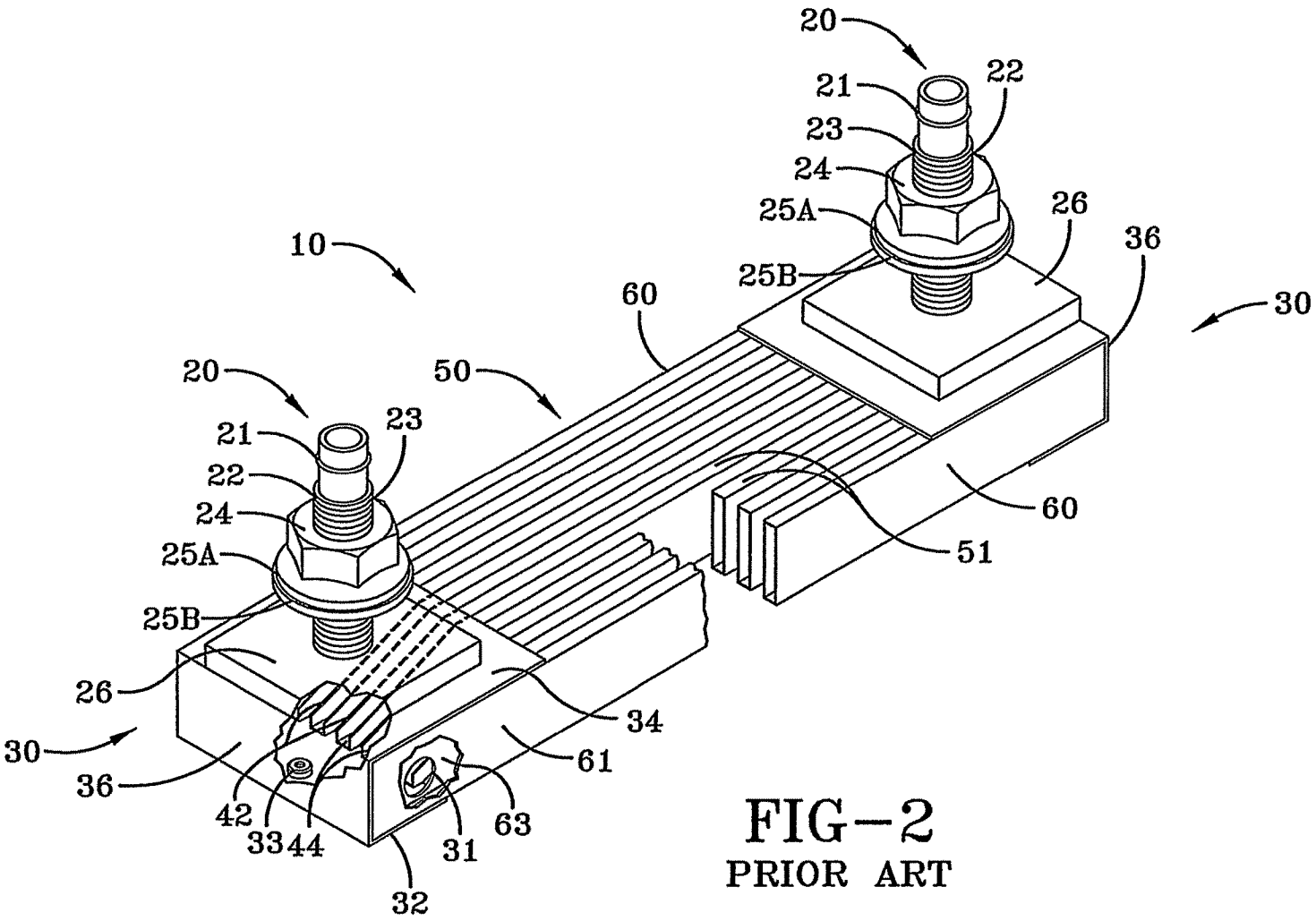
FIG-2 PRIOR ART
FIG. 2 is a perspective view of a keel cooler, including a partially cut-away view of the header and a cut-away view of coolant tubes with a rectangular cross section according to the prior art.

In the discussion above and to follow, the terms "upper", "inner", "downward", "end," etc. refer to the keel cooler, coolant tubes, or header as viewed in a horizontal position as shown in FIG. 2. This is done realizing that these units, such as when used on water going vessels, can be mounted on the side of the vessel, or inclined on the fore or aft end of the hull, or spaced from the hull, or mounted in various other positions.

Turning to FIG. 2, a keel cooler 10 according to the prior art is shown. Keel cooler 10 includes a pair of headers 30 at opposite ends of a set of parallel, rectangular coolant tubes 50 (also known as heat conduction or coolant flow tubes). Coolant tubes 50 include interior or inner coolant tubes 51 and exterior or outer coolant tubes 60. As shown in FIG. 2, headers 30 may have a generally prismatic construction, including an upper wall or roof 34, an end wall or back wall 36, and a bottom wall or floor 32. Header end walls 36 are perpendicular to the parallel planes in which the upper and lower surfaces of coolant tubes 50 are located. In some keel coolers, end wall 36 and floor 32 are formed at right angles, as shown in FIG. 2. However, as discussed below, other configurations of header are possible.

Keel cooler 10 is connected to the hull of a vessel through which a pair of nozzles 20 extend. Nozzles 20 have nipples 21 at the ends and cylindrical connectors 22 with threads 23. Nozzles 20 discharge coolant into and out of keel cooler 10. Large gaskets 26 each have one side against headers 30 respectively, and the other side engages the hull of the vessel. Rubber washers 25B are disposed on the inside of the hull when keel cooler 10 is installed on a vessel, and metal washers 25A sit on rubber washers 25B. Nuts 24 which typically are made from metal compatible with the nozzle 20, screw down on sets of threads 23 on connectors 22 to tighten the gaskets 26 and rubber washers 25B against the hull to hold keel cooler 10 in place and seal the hull penetrations from leaks. The gaskets 26 are provided for three essential purposes. First, they insulate the header to prevent galvanic corrosion. Second, they eliminate infiltration of ambient water into the vessel. Third, they permit heat transfer in the space between the keel cooler tubes and the vessel by creating a distance of separation between the keel cooler and the vessel hull, allowing ambient water to flow through that space. Gaskets 26 are generally made from a polymeric substance. In typical situations, gaskets 26 are between one-quarter inch and three-quarter inches thick.

The plumbing from the vessel is attached by means of hoses to nipple 21 and connector 22. A cofferdam or sea chest (part of the vessel) at each end (not shown) contains both the portions of the nozzle 20 and nut 24 directly inside the hull. Sea chests are provided to prevent the flow of ambient water into the vessel should the keel cooler be severely damaged or torn away, where ambient water would otherwise flow with little restriction into the vessel at the penetration location. The keel cooler described above shows nozzles for transferring heat transfer fluid into or out of the keel cooler. However, there are other means for transferring fluid into or out of the keel cooler. For example, in flange mounted keel coolers, there are one or more conduits such as pipes extending from the hull and from the keel cooler having end flanges for connection together to establish a heat transfer fluid flow path. Normally, a gasket is interposed between the flanges. There may be other means for connecting the keel cooler to the coolant plumbing system in the vessel. This invention is independent of the type of connection used to join the keel cooler to the coolant plumbing system.

Figure 3:
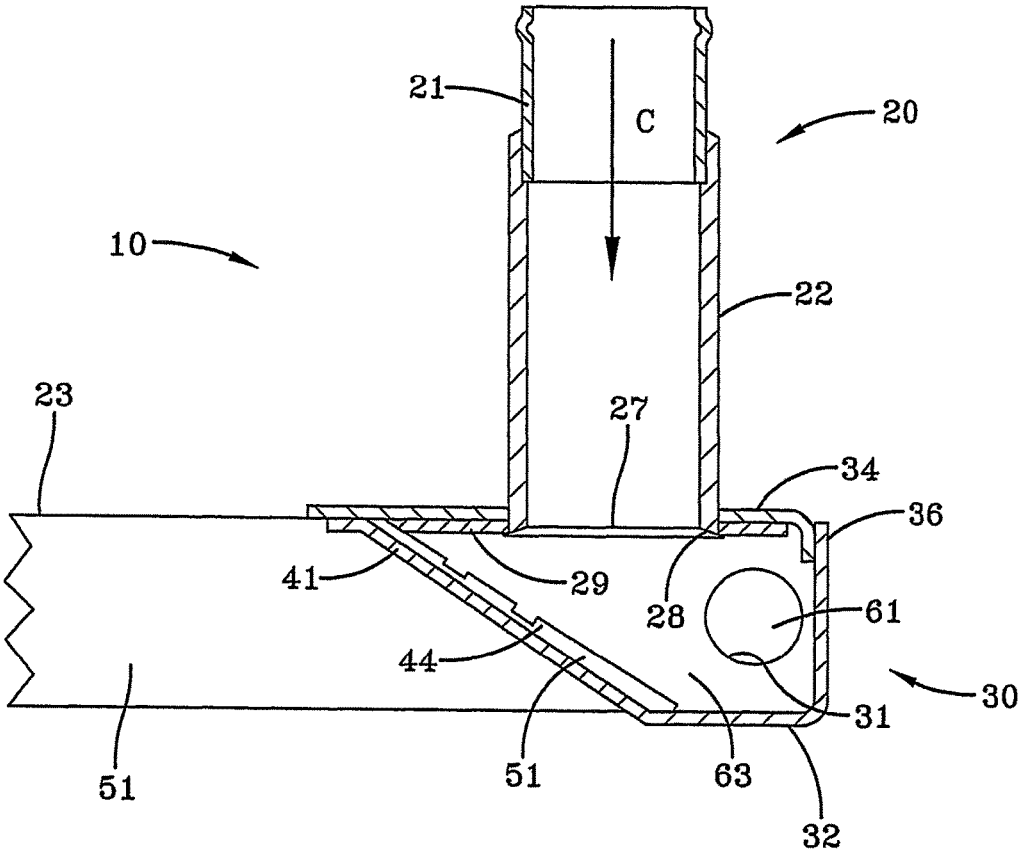
FIG-3 PRIOR ART
FIG. 3 is a cross-sectional view of a portion of a keel cooler according to the prior art, showing a header and part of the coolant tubes.

Turning to FIG. 3, which shows a portion of keel cooler 10 in cross section, nozzle 20 is shown connected to header 30. Nozzle 20 has nipple 21, and connector 22 has threads, as described above. Nipple 21 of nozzle 20 is normally brazed or welded inside of connector 22 which extends inside the hull. A flange 28 surrounds an inside orifice 27 through which nozzle 20 extends and is provided for helping support nozzle 20 in a perpendicular position on header 30. Flange 28 engages a reinforcement plate 29 on the underside of upper wall 34. In this manner, nozzle 20 can either be an inlet conduit for receiving hot coolant from the engine whose flow is indicated by the arrow C in FIG. 3, but also could be an outlet conduit for receiving cooled coolant from header 30 for circulation back to the heat source.

Referring to FIGS. 2-3, header 30 further includes an inclined surface or wall 41 composed of a series of fingers 42, which are inclined with respect to coolant tubes 50, and define spaces to receive end portions or cooling ports 44 of inner coolant tubes 51. End portions or ports 44 of inner coolant tubes 51 extend through inclined surface 41 and are brazed or welded to fingers 42 to form a continuous surface. Each exterior sidewall of header 30 is comprised of an outer rectangular coolant tube 60 that extends into header 30. FIGS. 2-3 show both sides of outer coolant tube 60, including an outermost sidewall 61, and an interior sidewall 63. A circular orifice 31 is shown extending through interior sidewall 63 of outer coolant tube 60, and is provided for carrying coolant flowing through outer coolant tube 60 into or out of header 30. Header 30 may also have a drainage orifice 33 for receiving a correspondingly threaded and removable plug for emptying the contents of keel cooler 10.

Because keel coolers are sometimes used in corrosive salt-water environments, keel coolers are typically made from 90-10 copper-nickel alloy, or some other material having a large amount of copper. This makes the keel cooler a relatively expensive article to manufacture and an object of the present invention to reduce the size of keel cooler would be advantageous for reducing overall material and manufacturing costs.

Figure 4:
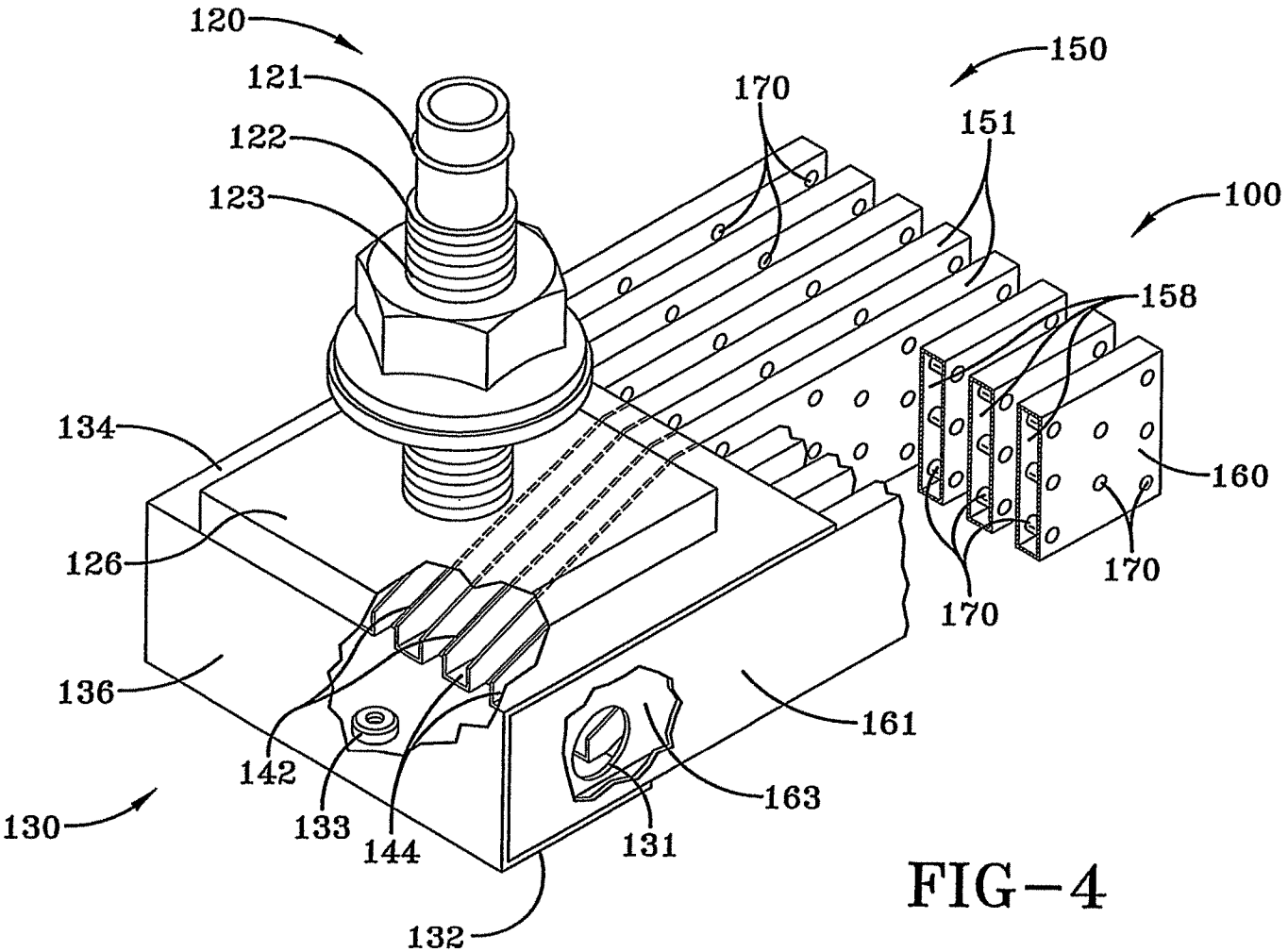
FIG. 4 is a perspective view of a portion of a keel cooler according to a preferred embodiment of the invention, including a partially cut-away view of square header and a cut-away view of coolant tubes with turbulence enhancers.

Turning to FIG. 4, a preferred embodiment of the present invention is shown. The embodiment includes a keel cooler 100 having at least one coolant tube 150 extending in a longitudinal direction from a header 130. Header 130 may be the same header 30 as described earlier according to the prior art, and includes an upper wall 134, an end wall 136, and a bottom wall 132. A nozzle 120 having a nipple 121 and a connector 122 with threads 123, may be the same as those described earlier and are attached to header 130. A gasket 126, similar to and for the same purpose as gasket 26, is disposed on top of upper wall 134. A drainage orifice 133 may also be provided for emptying the contents of keel cooler 100.

Also as shown in the embodiment of FIG. 4, keel cooler 100 includes coolant tubes 150 (also known as coolant flow or heat transfer fluid flow tubes, since in some instances the fluid may be heated instead of cooled). Coolant tubes 150 include interior or inner coolant tubes 151 and exterior or outer coolant tubes 160. Coolant tubes 150 may have a generally rectangular parallelepiped construction, including an elongated body portion between opposing end portions, each portion of which comprises a top wall, a bottom wall, and opposing sidewalls. Coolant tube 150 includes an interior surface 158 forming an internal channel through which the coolant flows. As shown in FIG. 4, inner coolant tubes 151 join header 130 through an inclined surface (not shown), which is composed of fingers 142 inclined with respect to inner coolant tubes 151 and which define spaces to receive open end portions or ports (i.e., inlets/outlets) 144 of inner coolant tubes 151. Open end portions 144 of inner coolant tubes 151 are shown as having a rectangular cross section and are angled to correspond with the angle of inclined surface and/or fingers 142. Outer coolant tubes 160 have outermost sidewalls 161, part of which are also the sidewalls of header 130. Outer coolant tubes 160 also have an interior sidewall 163 with an orifice 131, which is provided as a coolant flow port (i.e., inlet/outlet) for coolant flowing between the chamber of header 130 and outer coolant tubes 160. A header chamber is defined by upper wall 134, end wall 136, bottom wall 132, interior sidewalls 163, and any of inclined surface (not shown), fingers 142 and/or inner coolant tube end portions 144.

Also as shown in FIG. 4, coolant tubes 150 comprise a turbulence enhancer 170 or plurality of turbulence enhancers 170 arranged inside of coolant tubes 150 (including inner coolant tubes 151 and/or outer coolant tubes 160). As defined herein, a turbulence enhancer is a device or plurality of devices arranged inside of a coolant tube that provides a means for promoting or enhancing turbulence of the coolant flowing through a coolant tube for improving heat transfer without substantially increasing the pressure drop of the coolant to a level that detracts from the overall usefulness of the keel cooler.

Turbulence enhancers are an important aspect of the present invention and provide a number of important advantages to the keel cooler. As mentioned previously, whether fluid flow will result in turbulent flow is primarily determined by the Reynolds number, which is in part dependent on the velocity of the cooling fluid. In general, at a given fluid viscosity, a fluid flowing at a low velocity will provide laminar flow, and as the velocity of the fluid is increased, the fluid can become more turbulent. In a laminar flow regime, the coolant in contact with surfaces will have its velocity reduced by viscous drag, which forms an insulating boundary layer that can reduce heat transfer. However, as the fluid becomes more turbulent, the static and insulative boundary layer becomes unstable due to the fluid inertial forces overpowering the fluid viscous forces. This can cause the fluid to form turbulent eddies where the boundary layer breaks away from the wall, therefore disrupting or destroying the thermally insulative layer to improve heat transfer. Enhancing turbulence at a given fluid velocity or flow rate in order to disrupt, thin-down, or destroy the boundary layer is one way in which an embodiment of the present invention improves heat transfer.

Turbulence enhancers according to an embodiment of the present invention can achieve the foregoing means through the provision of inserts or impediments extending inwardly from a coolant tube interior surface into the coolant. As described herein, inserts may include separate parts and impediments may be integral with a coolant tube. A tremendous variety of inserts for turbulence enhancer are available. Among the factors regarding the inserts are the shape of the inserts, the placement of the inserts within the keel cooler tube, the pattern of inserts along the keel cooler tube, and the size of the respective inserts. An aspect of turbulence enhancers according to the invention is the provision of inserts having various configurations, such as cylindrical inserts with round, ellipsoid, or oval cross sections; hollow inserts, such as inserts with interior channels; inserts in the shape of a rectangular parallelepiped, such as with square or rectangular cross sections; pyramidal inserts, such as with triangular cross sections; flat bars; bars having a wing-shaped configuration; inserts with polygonal configurations; combinations of different configurations; or any variety of inserts having irregular cross sections. Inserts could be attached to the keel cooler walls in a number of ways depending in part on the nature of the insert and the type of wall involved. The inserts could be welded to the walls, the walls themselves could have a configuration which could convert part of them into impediments to cause heat transfer, having the inserts extend across the walls, and protrude through the walls where they could be welded or brazed in place so as to prevent any coolant leakage, and the like. The inserts could even extend in the longitudinal direction of the respective coolant tubes with appropriate supports.

Another aspect of turbulence enhancers is the provision of impediments to coolant flowing through the keel cooler tubes. Such impediments could be, amongst others, pins of various configurations, impediments sloped as chevrons, vane configurations having tear drop-shaped cross sections, impediments with or without orifices, impediments having undulating shapes, impediments having star-shaped cross sections, and the like. It should be understood that there are many factors which determine the best type of insert or impediment to increase heat transfer while not substantially increasing the pressure drop to a level that detracts from the overall performance and usefulness of the keel cooler. Some of these factors are the size and shape of the keel cooler tubes, the viscosity of the coolant, the temperature differential between the coolant and ambient water, and the like. In addition, the foregoing inserts or impediments could face in different directions inside the keel cooler tube, depending on the nature of the coolant, the shape and size of the keel cooler tube, the pressure of the coolant, amongst other factors. In preferred embodiments, inserts or impediments could be disposed in the bulk coolant for effecting turbulence enhancement.

An object of the present invention is that turbulence enhancers do not cause a substantial increase in pressure drop of the coolant to a level that detracts from the overall usefulness of the keel cooler. An acceptable pressure drop level may, of course, depend on the design considerations and pumping capacity of the particular marine engine or heat source to which keel cooler is plumbed. However, for many marine applications, a substantial increase in pressure drop may be defined as no greater than about a 10-percent increase over the pressure drop of a standard, or baseline, coolant tube configuration that lacks turbulence enhancers, such as those prior art coolant tubes having a generally rectangular cross section as shown in FIGS. 2-3. Preferably, the increase in pressure drop will be no greater than about 7-percent more than the baseline or standard tube configuration, and more preferably there will be no increase in pressure drop, and even more preferably there will be a reduction in pressure drop when incorporating turbulence enhancers according to the present invention.

Another aspect of turbulence enhancers according to an embodiment of the invention includes the arrangement of turbulence enhancers inside of the coolant tube, which includes the spacing between respective turbulence enhancers and the pattern and placement of turbulence enhancers within the coolant tube. Such patterns could be, amongst others, symmetrical or asymmetrical; parallelogram patterns, such as rectangular, square or diamond; triangular patterns; polygonal patterns; spiral, undulating and/or sinuous patterns; irregular or random patterns; and the like.

According to an embodiment of the invention, the arrangement of turbulence enhancers can affect the flow characteristics and pressure drop of the coolant in a manner that can be explained by the well-known Moody diagram (which is incorporated herein by reference in its entirety). According to the Moody diagram, for a given relative roughness factor of the surfaces over which the coolant flows, the friction factor will decrease as the Reynolds number increases (increasing turbulence), up to a limit defined by wholly turbulent flow. The friction factor can be defined as a resistance to flow, such that a reduction in friction factor will generally result in minimizing or reducing substantial pressure drop. Thus, turbulence enhancers according to a preferred embodiment of the invention provides a means for enhancing turbulence in order to minimize or reduce friction factor (and pressure drop). More particularly, one manner in which turbulence enhancers can achieve these means is through the arrangement of a plurality of turbulence enhancers in a narrow configuration for effecting a constriction of coolant flow in the areas between adjacently arranged turbulence enhancers. Constricting the coolant flow in this manner causes the coolant velocity to reach a maximum where there is a minimum cross-sectional spacing between adjacent turbulence enhancers, particularly where coolant flow is normal to the spacing between transversely adjacent turbulence enhancers. The increased velocity increases the Reynolds number of the coolant flowing between turbulence enhancers, and according to the Moody diagram, this reduces the friction factor to minimize or reduce the amount of pressure drop. However, turbulence enhancers should not be so narrowly arranged as to restrict coolant flow and increase pressure drop.

Turbulence enhancer structures and/or the arrangement of turbulence enhancers according to an embodiment of the invention can also minimize or reduce substantial pressure drop of the coolant by providing a means for enhancing turbulence through generating turbulent wakes in the coolant, which can also improve heat transfer. Turbulence enhancers can provide a means for generating these turbulent wakes through the provisions of inserts and/or impediments, as described above. In a preferred embodiment, turbulence enhancers extend from the coolant tube interior wall(s) into the bulk coolant to effect the development of turbulent wakes in the bulk coolant flow. When the coolant flows around a turbulence enhancer, the fluid flow is distorted and a boundary layer may be formed on the turbulence enhancer body in the same way as the boundary layer is formed at the coolant tube interior wall. As the coolant approaches the vertical boundaries of the turbulence enhancer body, fluid separation can develop leading to highly distorted fluid chunks, which may begin to rotate if they travel far enough downstream. At increased velocities (higher Reynolds numbers), the inertia of the fluid particles passing over a turbulence enhancer body can overcome the fluid viscosity, and the highly distorted fluid particles can separate to form a turbulent wake region extending downstream from the turbulence enhancer body. The turbulent wake region thus formed can interact with boundary layers that have developed on downstream turbulence enhancer bodies and coolant tube walls. Since the boundary layers can be a source of high resistance due to frictional shear, the enhanced eddying motion and increased Reynolds number of the turbulent wake region that acts to disrupt, thin-down, or destroy the boundary layers on downstream surfaces can lead to a reduced friction factor according to the Moody diagram, as described above. Moreover, disruption of the boundary layer in this manner destroys the thermal insulation, which increases heat transfer.

If coolant flow in the turbulent wake region becomes highly unsteady, large eddies or vortexes can be shed downstream from the turbulence enhancer body. This may require sufficient spacing in the arrangement between respective turbulence enhancers to allow turbulent vortexes to develop. Development of turbulent vortexes in the coolant can also increase Reynolds number and thus reduce friction factor on coolant tube walls and downstream turbulence enhancers, as described above. Therefore, yet another aspect of the turbulence enhancer structure and/or the arrangement of turbulence enhancers according to an embodiment of the present invention is to provide a means for enhancing turbulence by generating turbulent vortexes in the coolant for improving heat transfer without substantially increasing the pressure drop of the coolant. As used herein, the term vortex is defined as a region within a fluid where the flow is mostly a spinning or swirling motion about an imaginary axis, straight or curved. Therefore, the characteristic swirling motion of a turbulent vortex formed by turbulence enhancers can provide an effective means for mixing the bulk coolant and increasing eddying motion. Since, eddies can transport large quantities of thermal energy as they are mixed with the fluid, increasing eddying motion through turbulent vortex mixing can increase heat transfer by disrupting the boundary layer insulation and by taking large amounts of cooler fluid from the coolant tube wall region and distributing it into the hot bulk fluid regions.

It should be understood that aspects of turbulence enhancers according to preferred embodiments of the invention could provide benefits even where the coolant tube interior walls are smooth between respective turbulence enhancers. The smoothness of the coolant tube interior surface can be defined according to the relative roughness factor of the Moody diagram, such that a smooth tube according to an embodiment of the invention has a relative roughness factor between $9.74\times10^{-5}$ and $1.978\times10^{-4}$, and more preferably between $9.7\times10^{-5}$ and $1.2\times10^{-4}$. In certain embodiments, it may be preferable to have smooth coolant tube interior walls, since an increase in the relative roughness factor can restrict flow and increase friction factor (according to the Moody diagram), which could substantially increase pressure drop. It is believed that known prior art keel coolers having a plurality of roughness elements in the form of small protrusions or bumps on the coolant tube interior walls demonstrates this adverse phenomena, as it is known to suffer from substantial pressure drop.

It should also be understood that aspects of turbulence enhancers according to preferred embodiments of the invention can provide improvements regardless of whether the bulk coolant flow is laminar or turbulent. In other words, regardless of whether the flow rate is low and provides laminar flow, or whether the flow rate is increased to promote more turbulence, turbulence enhancers according to preferred embodiments of the invention can still improve heat transfer without a substantial increase in pressure drop. For example, where the bulk coolant flow is generally laminar, the insulative boundary layer at the coolant tube interior wall may be thicker (compared to when flow is more turbulent), however, turbulence enhancers according to preferred embodiments can still effectively cool the hot bulk fluid by providing a means for enhancing naturally occurring eddying motions through the generation of turbulent wakes and/or turbulent vortexes that effectively mix the coolant. Even as the coolant velocity increases to become more turbulent, turbulence enhancers that generate turbulent wakes and/or turbulent vortexes still enhance eddying motion and improve heat transfer. Therefore, it should be understood that an object of turbulence enhancers is to increase heat transfer independently of coolant velocity or flow rate.

It should also be understood that the corresponding structures, materials, acts, and equivalents of all means plus function elements of turbulence enhancers in the claims below are intended to include any structure, material, or acts for performing the functions in combination with other claimed elements as specifically claimed. Thus, for example, although turbulence enhancers have been described through the provision of inserts or impediments, and through other aspects such as spacing and patterns, other structures and arrangements may be provided. Accordingly, any specific embodiments pertaining to the structure or arrangement of turbulence enhancers through the provision of turbulators, including previously described inserts and impediments, should be understood to be non-limiting embodiments of the present invention.

Figure 5A:
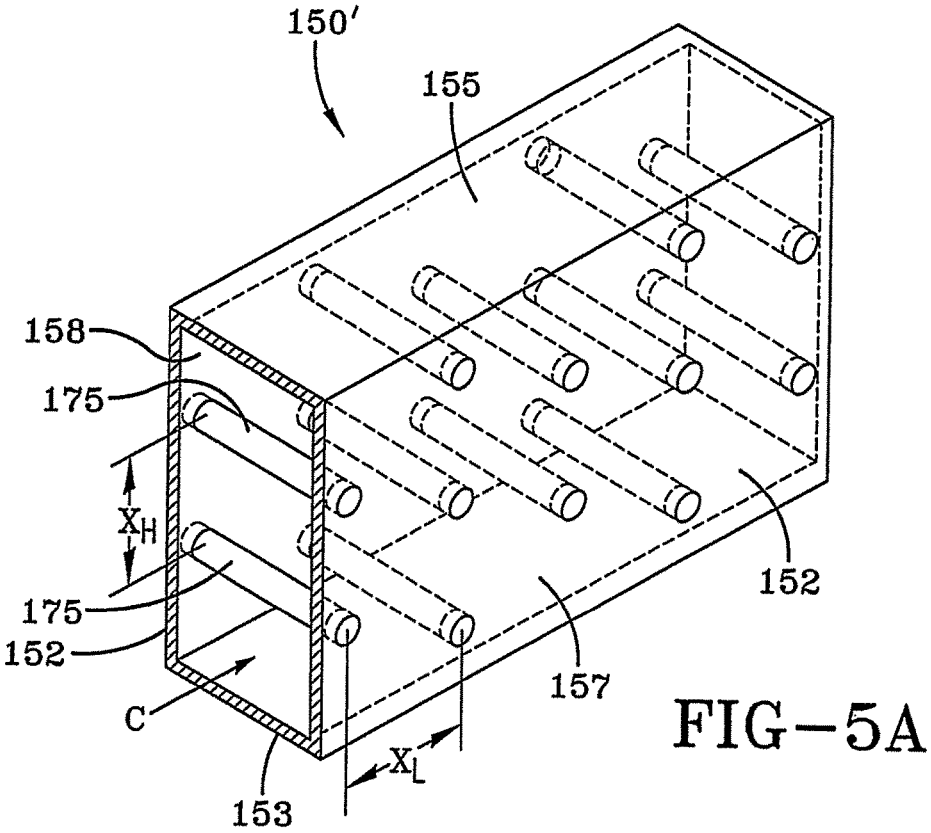
FIG. 5A is a perspective, cross-sectional view of a portion of a coolant tube showing a plurality of solid cylindrical turbulators arranged in a staggered pattern inside of coolant tube according to a preferred embodiment of the invention.
Figure 5B:
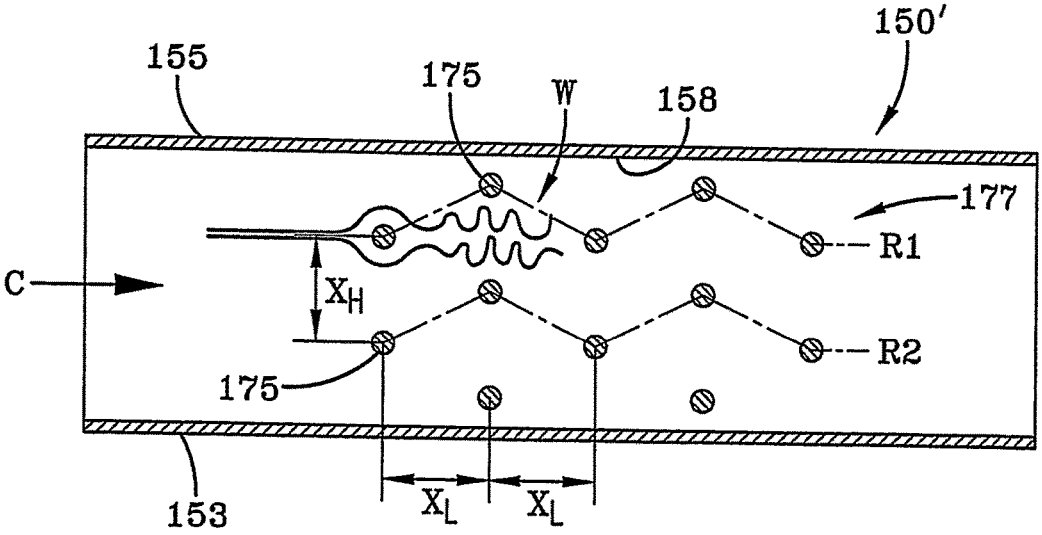
FIG. 5B is a cross-sectional view thereof, and further including a schematic of coolant fluid flow and turbulent wake (W) region.

Turning now to FIGS. 5A-5B, a coolant tube 150' comprising turbulators 175 according to a preferred embodiment of the invention is shown. Turbulators may be inserts or impediments, as described above, which are arranged inside of coolant tube. As described herein, a turbulator according to an embodiment of the present invention can be a device or plurality of devices arranged inside of a coolant tube that promotes or enhances turbulence of the coolant flowing through coolant tube for enhancing heat transfer without substantially increasing the pressure drop of the coolant to a level that detracts from the overall usefulness of the keel cooler. The turbulator configurations and/or the arrangement of turbulators according to an embodiment of the invention can also enhance turbulence by generating turbulent wakes and/or turbulent vortexes for improving heat transfer without substantially increasing pressure drop, as those attributes were also described above and are further described below.

FIGS. 5A-5B show an embodiment of coolant tube 150' having a rectangular parallelepiped construction, including an elongated body portion having an exterior surface 157 and an interior surface 158 between opposing coolant tube end portions (not shown). Coolant tube interior surface 158 forms an internal channel through which coolant flows. Coolant tube 150' is shown as having opposing sidewalls 152, a top wall 155, and a bottom wall 152 that opposes top wall 153. In a preferred embodiment, coolant tube 150' has a rectangular cross section for allowing a set of parallel coolant tubes 150' to be spaced relatively close to each other for increasing the effective heat transfer area of the keel cooler. Coolant tube 150' may include inner coolant tube and outer coolant tube (not shown), which may have the same general features of inner coolant tube 151 and outer coolant tube 160, respectively described above.

As shown in the embodiment of FIGS. 5A-5B, coolant tube 150' comprises a plurality of turbulators 175. As shown, turbulators 175 can have an elongated body portion that extends from coolant tube interior surface 158 into the bulk coolant flow path. In a preferred embodiment, turbulators 175 extend between opposing sidewalls 152, however, turbulators 175 could also extend between opposing top wall 155 and bottom wall 153, or could even extend between sidewall 152 and either top wall 155 or bottom wall 153, or in some instances may only extend part-way across the interior. As shown in the embodiment of FIG. 5A, the elongated body portion of respective turbulators 175 is substantially parallel to bottom wall 153 and top wall 155. Turbulators 175 may have an elongated body portion or bar portion with a longitudinal axis that is perpendicular or normal to the direction of bulk coolant flow (C). Turbulators 175 may be perpendicular or orthogonal to opposing sidewalls 152, but could also be perpendicular to opposing top wall 155 and bottom wall 153. However, in other embodiments, turbulators 175 may be angled into or away from the direction of coolant flow, or may be oriented in varying directions.

In the embodiment shown in FIGS. 5A-5B, turbulators 175 are configured as solid cylinders having round cross sections. However, other cross-sectional configurations could include: round, ellipsoid, oval, rectangular, square, triangular, wing-shaped, airfoil-shaped, polygonal, irregular, and the like. Turbulators 175 are arranged in a predetermined pattern, which may be an offset or staggered turbulator pattern 177 as shown in FIGS. 5A-5B, but could also have turbulators 175 aligned in straight rows, or could be in any type of symmetrical or asymmetrical pattern. As shown in FIG. 5B, staggered turbulator pattern 177 includes a plurality of longitudinal rows (e.g., R1, R2) in the direction of coolant flow (C). Within each row, respective longitudinally adjacent turbulators 175 are spaced by a distance ($X_L$); and between adjacent rows, transversely adjacent turbulators 175 are spaced by a distance ($X_H$). In staggered turbulator pattern 177 of FIG. 5B, respective longitudinally adjacent turbulators in the same row are transversely offset in an alternating staggered manner. According to an object of the present invention, an equation was developed for defining a turbulator pattern spacing ratio (β), the equation defined as $X_L=\beta*X_H$. In preferred embodiments of the invention, respectively adjacent turbulators 175 may be spaced evenly with a spacing ratio of β=1, or the spacing may be uneven with a spacing ratio where 1<β<1.

A series of experiments were conducted to evaluate the effect of turbulator 175 according to several embodiments of the present invention. The experimental apparatus comprised a 32 inch long segment of a keel cooler coolant tube disposed inside of a chamber that flowed "external" cooling water over the exterior surface of the coolant tube segment. The coolant tube flowed internal coolant (the coolant being water) through its interior channel. Although keel cooler coolants typically comprise a glycol mixture, the viscosity and characteristics of water were sufficiently similar for the purposes of experimental comparison. Thermocouples were placed throughout the apparatus to measure the coolant tube shell (exterior wall) temperature, the coolant inlet temperature and coolant outlet temperature. Based on the thermocouple readings, the logarithmic mean temperature difference (LMTD) was calculated. Based on the calculated LMTD, measured flow rate and fluid specific heat, the overall heat transfer coefficient was calculated for various internal and external flow rates. Pressure transducers located at the inlet and outlet ports measured pressure drop of the coolant across the coolant tube segment. In each experiment, the coolant tube material and dimensions remained constant. The test was conducted over a range of flow rates with a coolant inlet temperature of 98° F. and an ambient shell temperature of 75° F. The coolant tube segment in each series of experiments was substantially the same, having a rectangular cross section measuring 0.375 inches wide by 2.375 inches in height. The coolant tube segment was made of a 90-10 copper-nickel alloy and had a wall thickness of about 0.062 inches. The surface roughness or relative roughness factor of the coolant tube interior walls was substantially equivalent for each setup, and ranged from about 63 to 125 micro-inches.

Three configurations were tested in the experimental apparatus. The first configuration was a coolant tube lacking turbulators, which represented the baseline condition (hereinafter, the "baseline configuration"). The second configuration comprised turbulators 175 according to the embodiment depicted in FIGS. 5A-5B and having staggered turbulator pattern 177 with an even spacing ratio (β=1) (hereinafter, the "narrow turbulator configuration"). The third configuration also comprised turbulators 175 arranged in a staggered turbulator pattern 177 according to the embodiment depicted in FIGS. 5A-5B, which maintained the same transverse spacing ($X_H$) as the second configuration, but widened the longitudinal spacing ($X_L$) compared to the second configuration, such that β=4 (hereinafter, the "wide turbulator configuration"). For the second and third configurations, turbulators were inserted into the coolant tube segment by drilling holes through coolant tube sidewalls, inserting turbulators into the holes and brazing turbulators in place. For these experiments, turbulators had a solid round cross section and were about 0.100 inches in diameter; and turbulator pattern had a transverse spacing ($X_H$) of about 0.765 inches between respectively adjacent turbulators.

Figure 6:
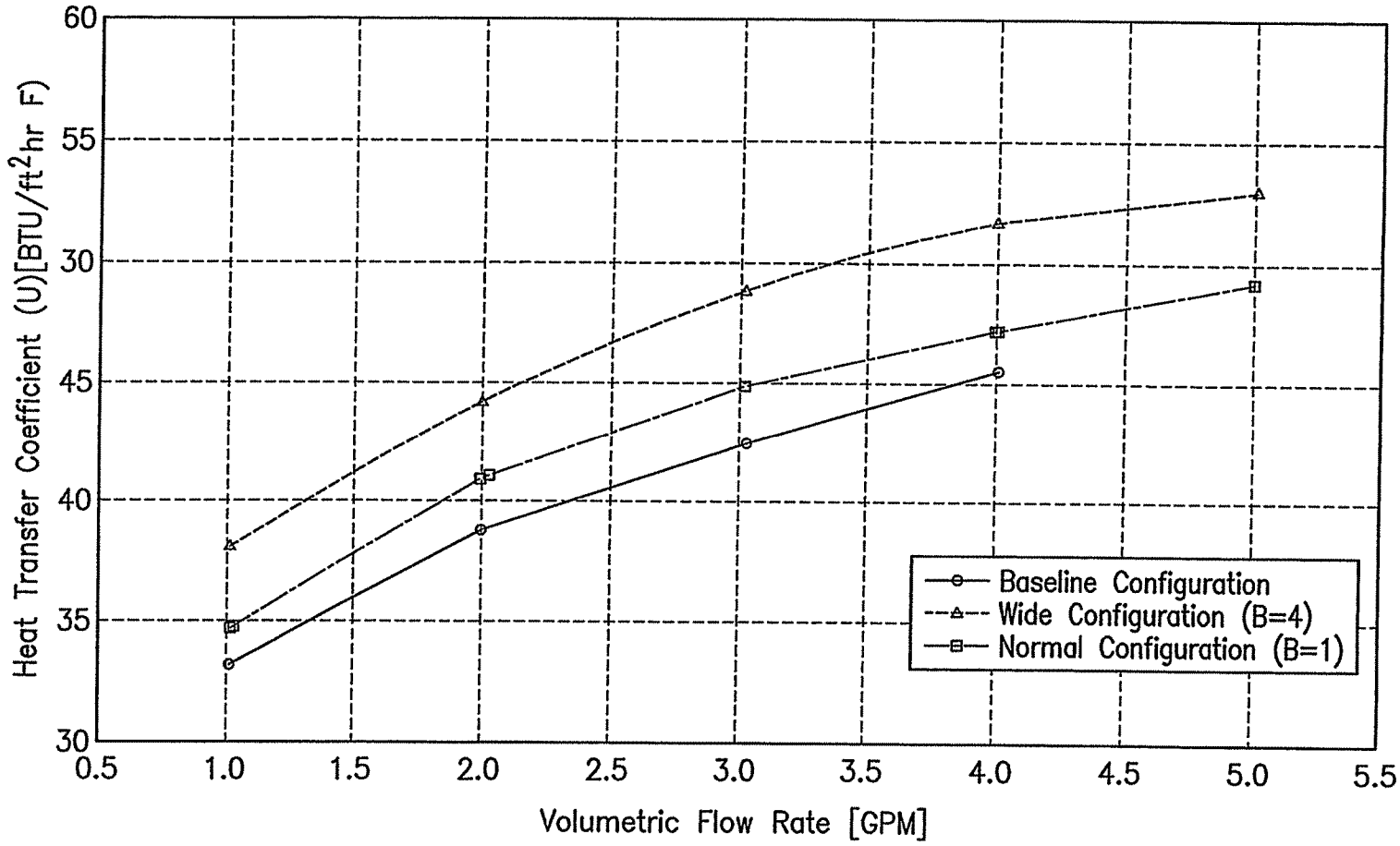
FIG. 6 is a chart showing experimental results of heat transfer coefficient versus volumetric flow rate for various preferred embodiments of the invention that were tested and compared against the prior art.

The effect of turbulators and turbulator pattern spacing ratio (β) on heat transfer coefficient versus flow rate is shown in the graph of FIG. 6. Each series of results in FIG. 6 represents the average of three experiments. The results indicate that turbulators according to embodiments of the present invention improve heat transfer coefficient over the baseline configuration over the entire range of flow rates tested. In particular, the narrow turbulator configuration (β=1) had a 4-percent increase in heat transfer coefficient over the baseline configuration, and the wide turbulator configuration (β=4) had a 10-percent increase in heat transfer coefficient over the baseline configuration. It is believed based on these experiments that other configurations may yield larger increases in heat transfer.

Figure 7:
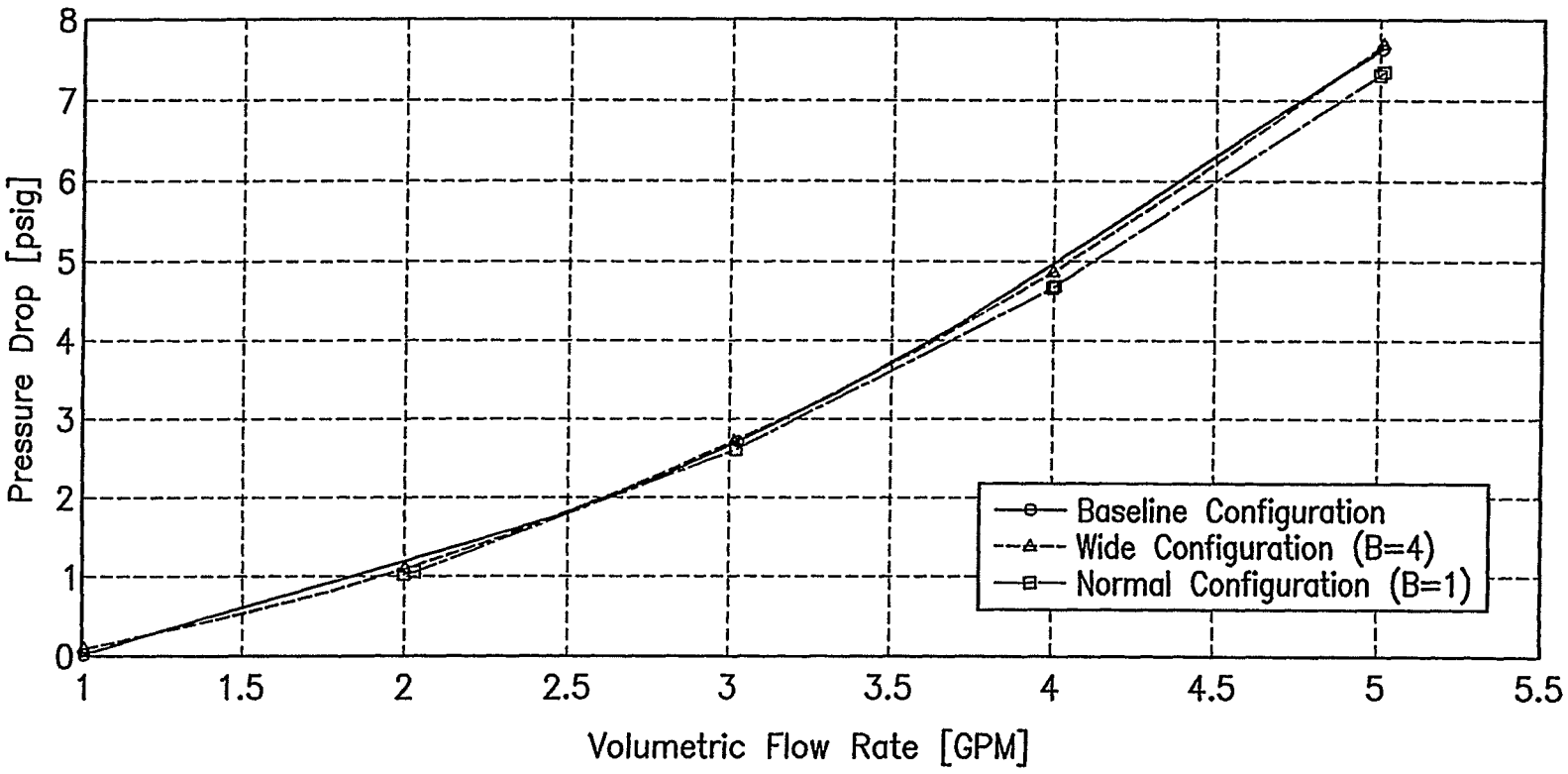
FIG. 7 is a chart showing experimental results of pressure loss versus volumetric flow rate for various preferred embodiments of the invention that were tested and compared against the prior art.

The effect of turbulators and turbulator pattern spacing ratio (β) on pressure drop versus flow rate is shown in the graph of FIG. 7. The results of FIG. 7 represent the average of the same three experiments for each series shown in FIG. 6. The results indicate that turbulators according to embodiments of the present invention do not increase pressure drop over the baseline configuration. In particular, the wide turbulator configuration (β=4) had an equivalent pressure drop to the baseline configuration, and the narrow turbulator configuration (β=1) demonstrated an unexpected reduction in pressure drop compared to the baseline condition. These results were so surprising that the instrumentation, including pressure transducers, were recalibrated twice. Although not shown in FIGS. 6-7, the testing was also conducted at inlet temperatures of 118° F. and 130° F. for all three configurations and the results showed the same trends.

Figure 8A:
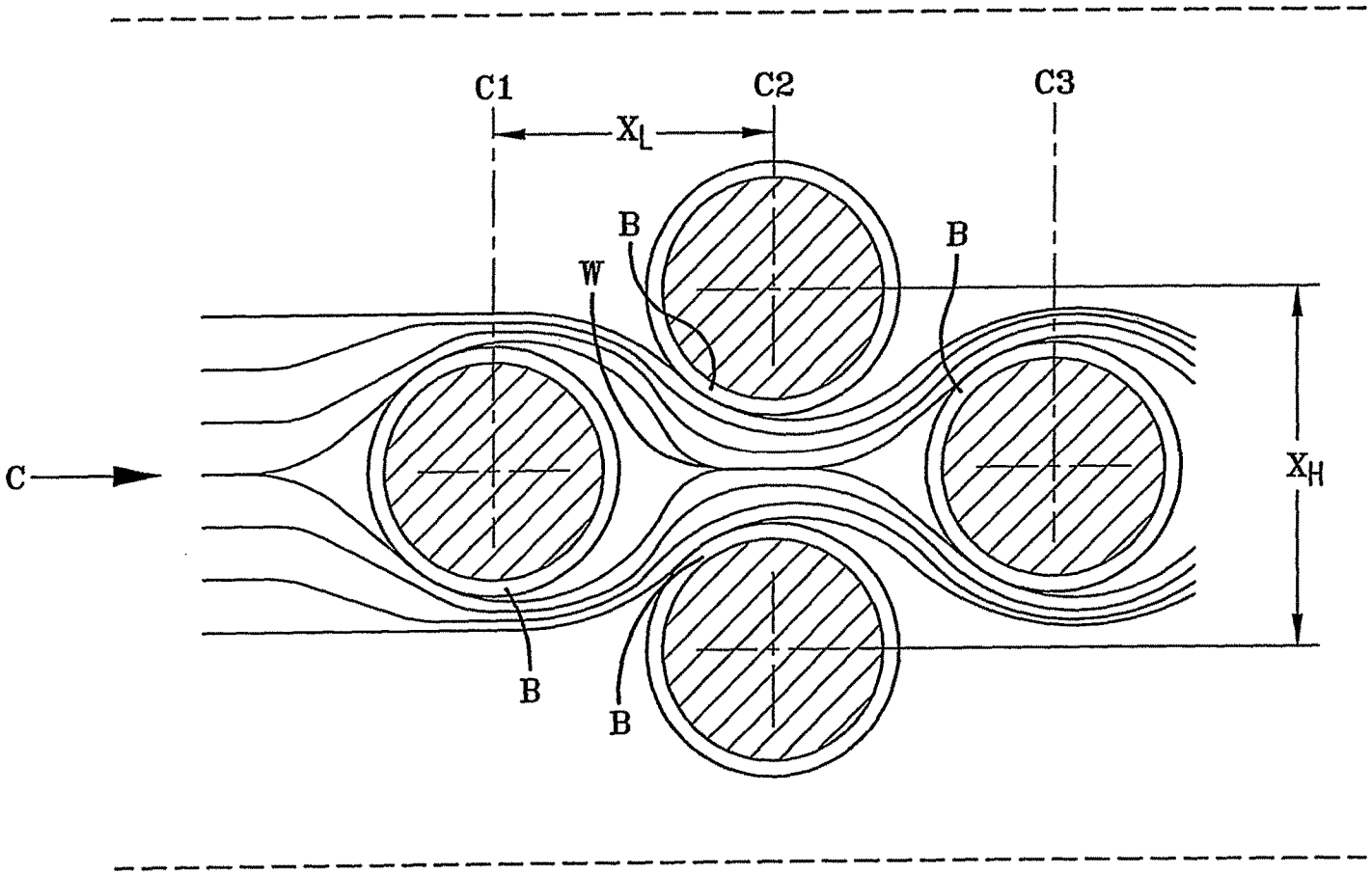
FIG. 8A is a schematic cross-sectional view of a coolant tube and turbulators in a spaced pattern showing coolant flow paths, boundary layers, and turbulent wakes.
Figure 8B:
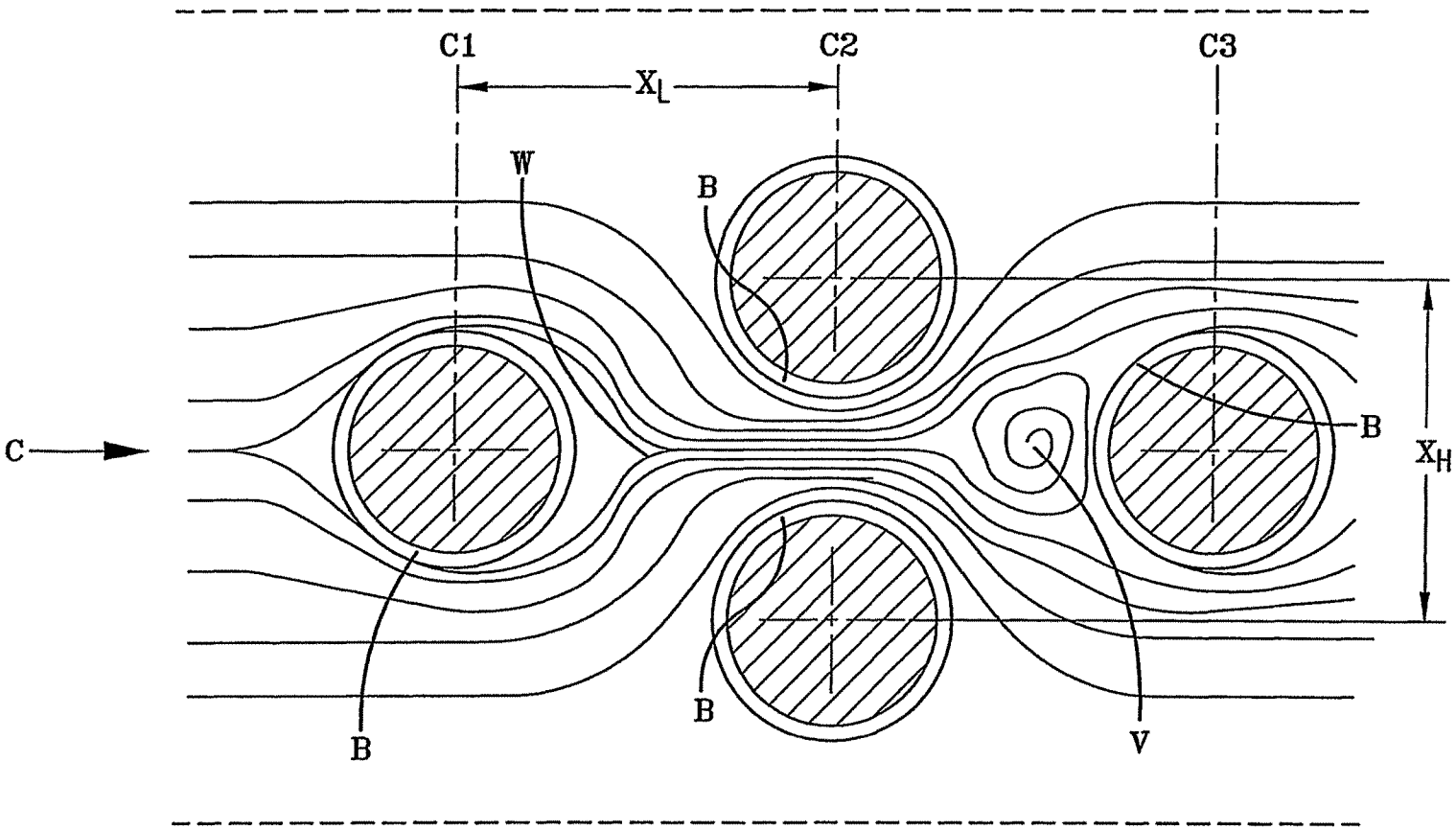
FIG. 8B is a schematic cross-sectional view of a coolant tube and turbulators in a spaced pattern showing coolant flow paths, boundary layers, and turbulent vortexes.

It is believed that the narrow turbulator configuration (β=1) yields larger Reynolds numbers (increased turbulence) because of the closer spacing of respective turbulators constricting the fluid to effect an increase in fluid velocity, as previously explained. The spacing in this configuration is not so narrow as to restrict fluid flow and cause a substantial increase in the resistance to flow or pressure drop. As shown in the schematic of FIG. 8A, the reason for the lower pressure drop according to this narrow configuration is believed to be best explained by the turbulent wake region (W) that develops behind upstream turbulators (e.g., C1), and which then interacts with the boundary layer (B) of downstream turbulators (e.g., C3). As previously explained, increasing the eddying motion through turbulent wakes can disrupt downstream boundary layers which are a source of frictional shear, therefore, increasing turbulence results in a reduction of friction factor (according to the Moody diagram) and minimizes pressure drop. On the other hand, as shown in the schematic of FIG. 8B, the wider turbulator configuration (β=4) is believed to have enough longitudinal spacing ($X_L$) between respective turbulators to allow the turbulent wakes (W) that are generated from upstream turbulators (C1) to shed away and form a vortex or vortexes (V), which enhances the mixing action of the fluid and further improves heat transfer. The turbulent wakes (W) and/or vortex (V) are also believed to enhance turbulence and act to disrupt the boundary layer (B) on downstream turbulators (C3) in a similar manner that that does not substantially increase pressure drop.

In order to visually verify the development of turbulent wakes (W) and/or turbulent vortexes (V) according to the above experimental results, a replica of the coolant tube segment and turbulator configuration could be made with a clear material, such as polycarbonate. Each of the same turbulator configurations could be tested, whereby coolant (e.g., water) could be flowed at the same flow rates and a dye could be injected into the flow stream for visual identification of the flow characteristics. Where the fluid would display rapid fluctuations in the dyed flow stream in an extended wake region downstream from the turbulator body, a turbulent wake region would be considered developed. Where the dyed fluid would display a swirling vortex motion, a turbulent vortex would be considered developed. Such testing is easy to conduct and is commonly utilized for characterizing fluid flow. These tests could even precede the above-mentioned heat transfer experiments as an adequate screening tool.

In certain preferred and non-limiting embodiments of the invention, turbulators may be arranged in a staggered turbulator pattern wherein the spacing ratio (β) is preferably in the range between about 0.75 to 9, and more preferably in the range between about 1 to 7. In some preferred embodiments, it may be beneficial to improve heat transfer as much as possible without a substantial increase in pressure drop, which may correspond to a wide turbulator configuration wherein the spacing ratio (β) is preferably greater than about 3.5, and more preferably in the range between about 3.5 and 9. In still other preferred embodiments, it may be beneficial to minimize or reduce the pressure drop according to a narrow turbulator configuration wherein the spacing ratio (β) is preferably in the range between about 0.75 to 3.5, and more preferably in the range between about 1 to 3. As shown in the embodiment of FIGS. 5A-5B, turbulator 175 may be a solid cylinder or bar that extends between coolant tube sidewalls 152, wherein turbulator 175 is configured with a round cross section having a diameter between 0.030 inches and 0.250 inches, and more preferably between 0.075 inches to 0.125 inches, and even more preferably 0.090 inches to 0.110 inches. In certain preferred embodiments, coolant tube may have a rectangular cross section with typical cross-sectional dimensions of 1.375 in.×0.218 in., 1.562 in.×0.375 in., or 2.375 in.×0.375 in. for increasing the effective area of the keel cooler.

Figure 9A:
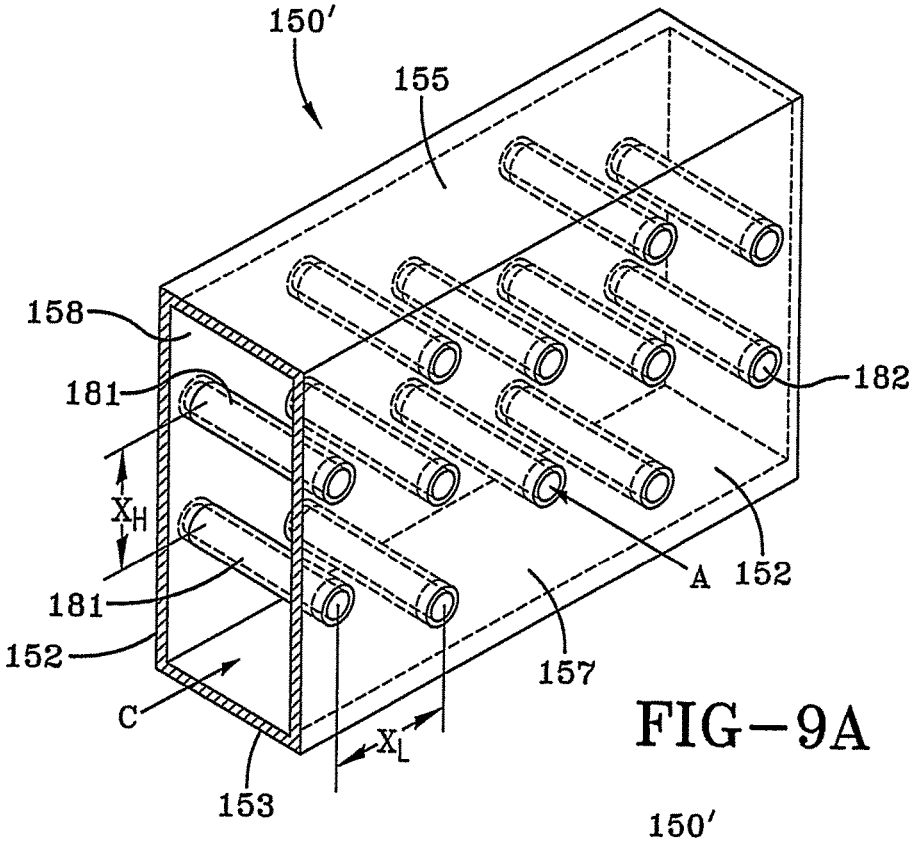
FIG. 9A is a perspective, cross-sectional view of a portion of a coolant tube showing a plurality of hollow cylindrical turbulators arranged in a staggered pattern inside of coolant tube according to a preferred embodiment of the invention.
Figure 9B:
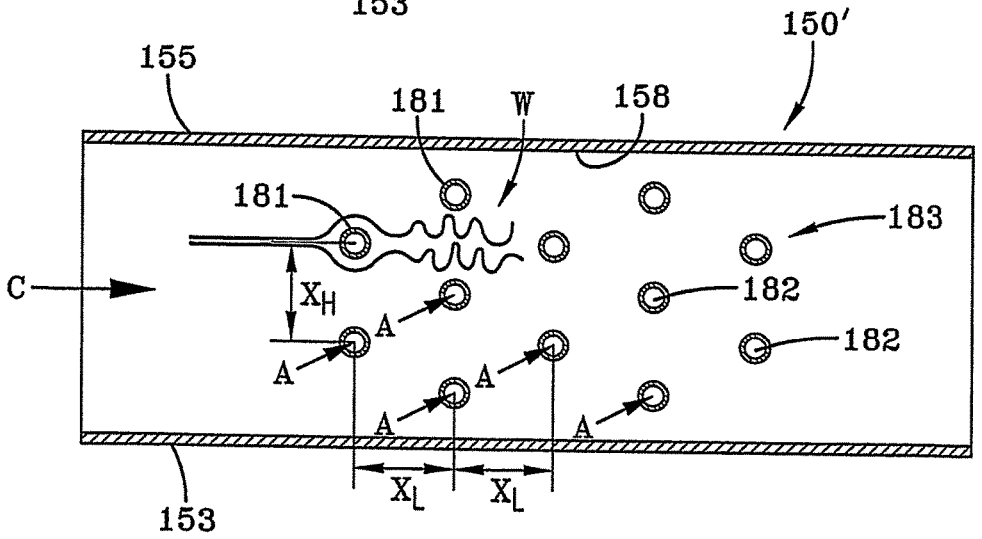
FIG. 9B is a cross-sectional view thereof, and further including a schematic of coolant fluid flow and turbulent wake (W) region.

It should be understood that turbulators according to preferred embodiments of the present invention may have different geometric configurations and/or different turbulator patterns within a coolant tube for enhancing turbulence to improve heat transfer without substantially increasing pressure drop. In another preferred embodiment of the invention, shown in FIGS. 9A-9B, turbulator 181 comprises an elongated body portion or bar portion configured as a hollow cylindrical tube having a round cross section. Turbulator 181 further comprises round-shaped openings on opposing end portions that form a turbulator interior channel 182 therebetween. The purpose of turbulator interior channel 182 is to allow ambient "external" water (A) to flow through turbulator interior channel 182 in order to decrease turbulator 181 wall temperature and promote heat transfer with the internal coolant (C). As with the embodiment of FIGS. 5A-5B, coolant tube 150' of FIGS. 9A-9B may have a rectangular parallelepiped construction, including an elongated body portion having an exterior surface 157 and an interior surface 158 between end portions (not shown) that forms an internal channel through which coolant flows. Coolant tube 150' in FIGS. 9A-9B includes a plurality of turbulators 181 that extend from coolant tube interior surface 158 into the bulk coolant flow, and which can be arranged in similar manners to turbulators described above. Turbulators 181 may extend between opposing sidewalls 152, however, turbulators 181 could also extend between opposing top wall 155 and bottom wall 153. As shown, the elongated body portion of turbulators 181 may be substantially parallel to bottom wall 153 and top wall 155. Turbulators 181 may have an elongated body portion with a longitudinal axis that is perpendicular or orthogonal to opposing sidewalls 152, which may also be normal to the direction of bulk coolant flow (C) as shown. In the embodiment of FIGS. 9A-9B, turbulators 181 are arranged in a predetermined staggered pattern 183, which can be the same as the foregoing staggered pattern 177, including a longitudinal spacing ($X_L$) between longitudinally adjacent turbulators 181, and a transverse spacing ($X_H$) between transversely adjacent turbulators 181. Turbulators 181 according to certain embodiments may be arranged with the same preferred ranges of turbulator spacing ratio (β) and may have the same preferred ranges of turbulator diameter as defined with respect to the embodiment of FIGS. 5A-5B. In order to maximize the effect of heat transfer through turbulator 181 and into the ambient water flowing through turbulator interior channel 182, turbulator 181 may preferably have a wall thickness between about 0.035 inches and 0.125 inches, or more preferably between about 0.040 inches and 0.080 inches.

Figure 10A:
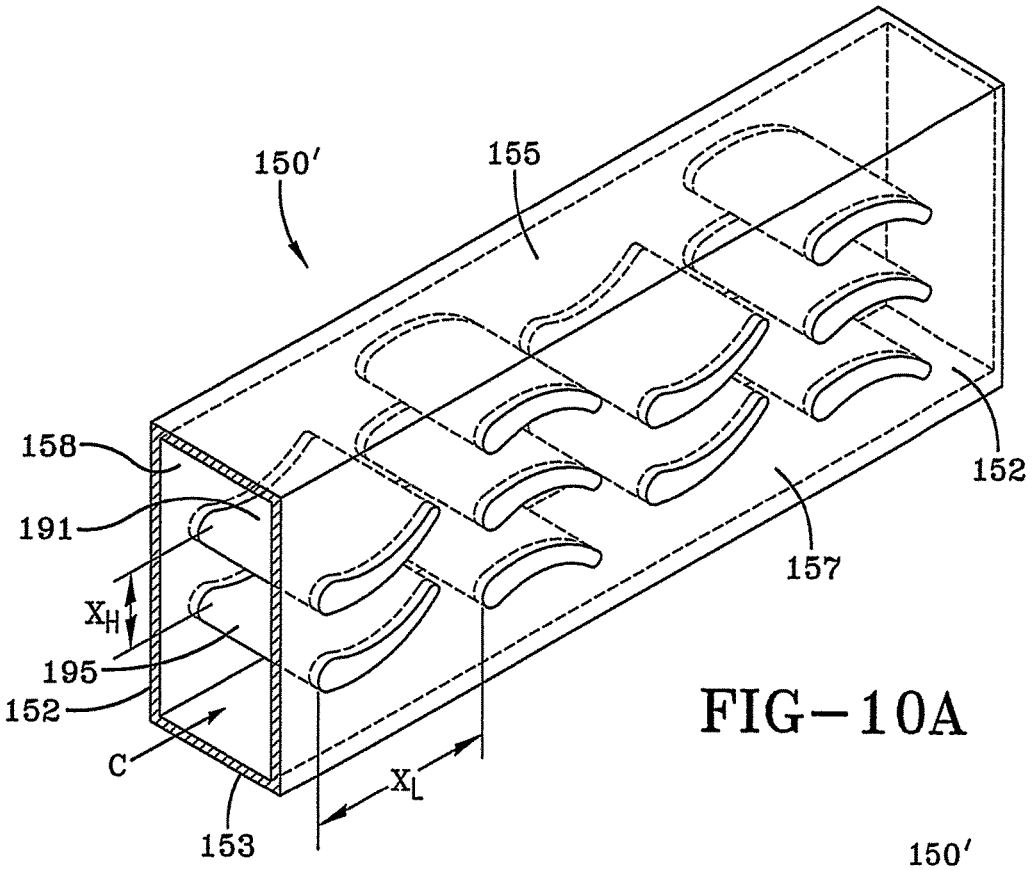
FIG. 10A is a perspective, cross-sectional view of a portion of a coolant tube showing a plurality of wing-shaped turbulators arranged in a staggered pattern inside of coolant tube according to a preferred embodiment of the invention.
Figure 10B:
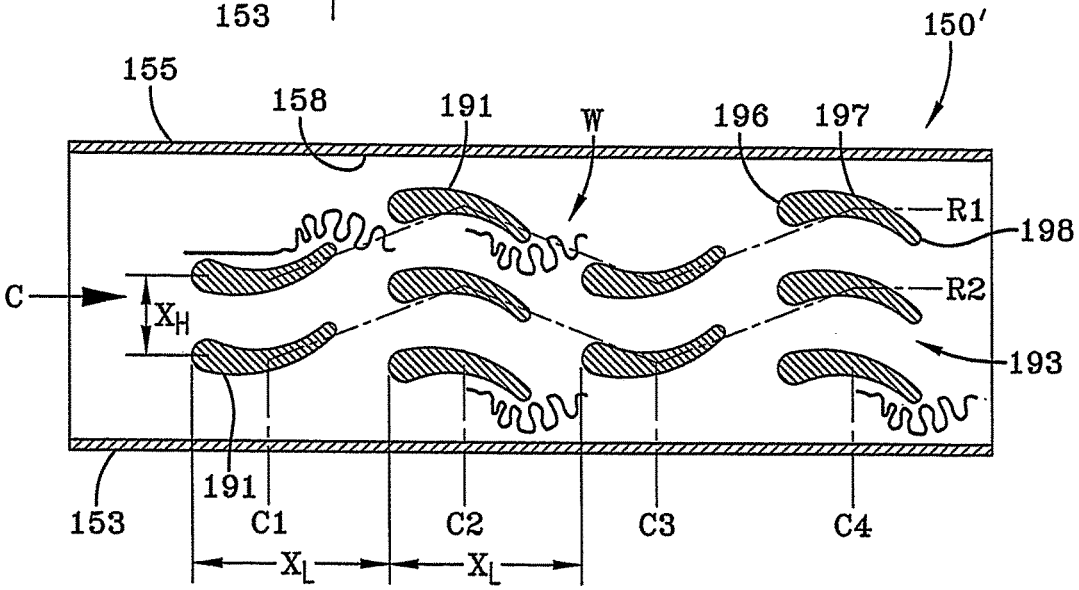
FIG. 10B is a cross-sectional view thereof, and further including a schematic of coolant fluid flow and turbulent wake (W) region.

Turning to FIGS. 10A-10B, another embodiment of a turbulator 191 is shown being arranged in a predetermined pattern as a plurality of turbulators 191 inside of coolant tube 150'. Coolant tube 150' may be the same as previously described coolant tubes, including elongated body portion having interior surface 158, exterior surface 157, top wall 155, bottom wall 153, and opposing sidewalls 152. As shown, turbulator 191 includes an elongated body portion 195 configured as a bar that extends from coolant tube interior surface 158 into the bulk coolant flow (C), and which can be arranged in similar manners to turbulators described above. As shown in the cross-sectional view of FIG. 10B, turbulator 191 includes a leading head portion 196, an intermediate portion 197 having a concave surface, and a trailing tail portion 198. The purpose of wing-shaped turbulator 191 is to direct the flow of turbulent wakes (W) and/or turbulent vortexes toward downstream turbulators 191 or coolant tube interior surfaces 158 in order to disrupt the boundary layer in those regions to further improve heat transfer and minimize or reduce substantial pressure drop. As shown in the embodiment of FIGS. 10A-10B, turbulators 191 are arranged in a predetermined staggered pattern 193, which can be similar to the foregoing staggered patterns, including a longitudinal spacing ($X_L$) between longitudinally adjacent turbulators 191, and a transverse spacing ($X_H$) between transversely adjacent turbulators 191. The longitudinal ($X_L$) and transverse ($X_H$) spacing may be measured from the leading edge of turbulator 191, as shown. Accordingly, turbulators 191 in certain preferred embodiments may have the same ranges for turbulator spacing ratio (β) as described with respect to the embodiment of FIGS. 5A-5B. In addition, as shown in FIG. 10B, turbulators 191 may be arranged in an alternating pattern along respective longitudinal rows (e.g., R1, R2), wherein the concave surface of turbulator intermediate portion 197 faces a first wall (e.g., top wall 155) in a first series (C1), and faces an opposing second wall (e.g., bottom wall 153) in a second series (C2) longitudinally spaced from the first series (C1), and returns to facing the first wall (e.g., top wall 155) in a third series (C3) longitudinally spaced from the second series (C2), and so on. Further still, turbulator 191 can be rotated about its central axis in a predetermined arrangement within coolant tube 150' wherein the concave surface of intermediate portion 197 faces more of an upstream flow, or can be oriented to face more of a downstream flow depending on how turbulent wakes and/or turbulent vortexes are to be directed toward downstream areas.

Figure 11:
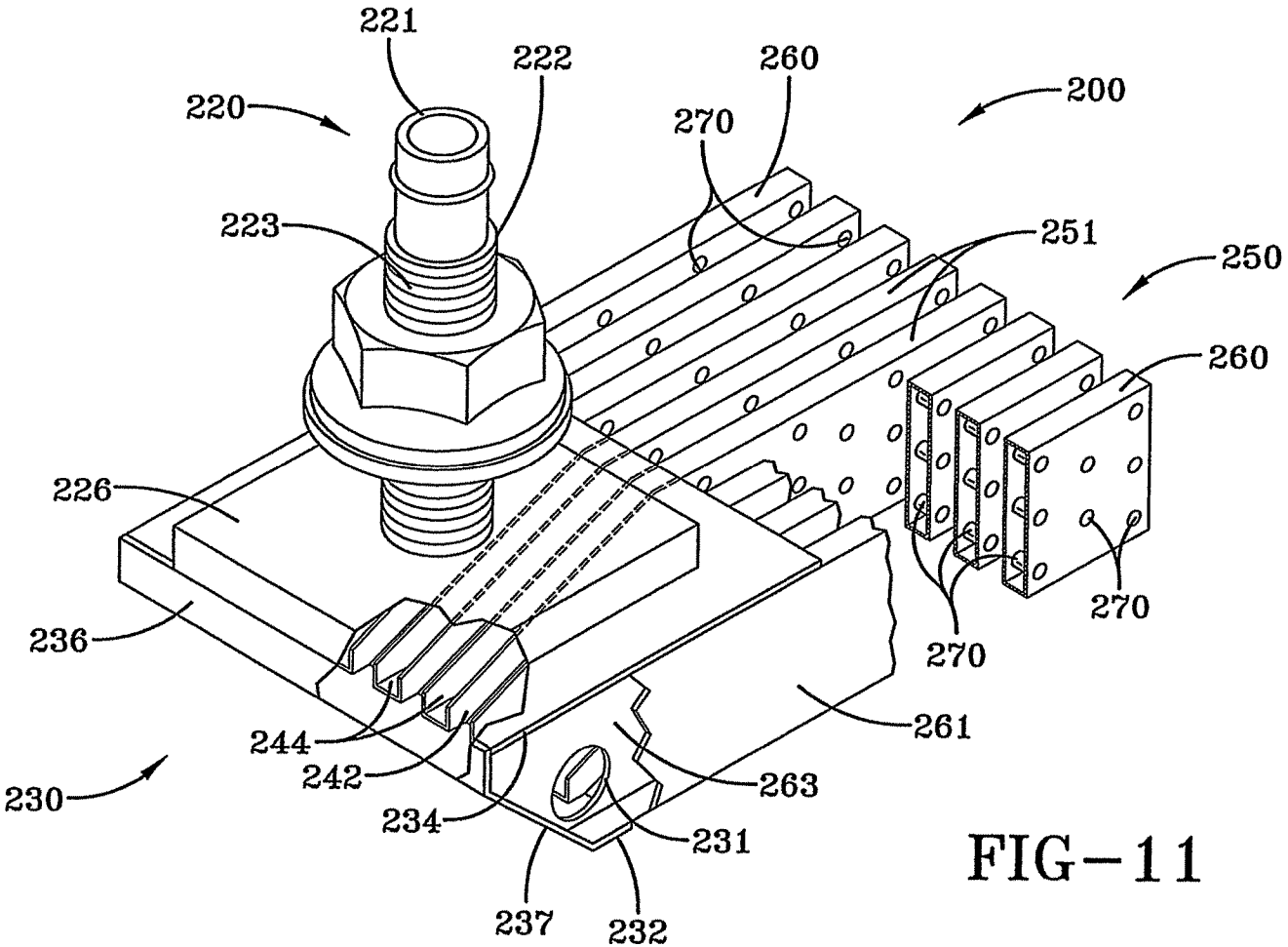
FIG. 11 is a perspective view of a portion of a keel cooler according to a preferred embodiment of the invention, including a partially cut-away view of beveled header and a cut-away view of coolant tubes with turbulence enhancers.

It should be understood according to objects of the present invention that turbulence enhancers or turbulators, including the provisions of inserts and/or impediments, may be incorporated into the coolant tubes of different types of keel coolers. For example, a keel cooler 200 according to an embodiment of the invention is shown in FIG. 11. Keel cooler 200 is the same as a keel cooler described in U.S. Pat. No. 6,575,227 (by the present assignee and incorporated herein by reference in its entirety), except for the incorporation of turbulence enhancers 270 according to the present invention. As shown in FIG. 11, keel cooler 200 includes a header 230, which is similar to header 130 as described earlier according to the invention. Header 230 includes an upper wall 234, an end wall 236 preferably transverse to upper wall 234, and a beveled bottom wall 237 beginning at end wall 236 and terminating at a generally flat bottom wall 232. A nozzle 220 having nipple 221 and connector 222 with threads 223, may be the same as those described earlier and are attached to header 230. A gasket 226, similar to and for the same purpose as gasket 126, is disposed on top of upper wall 234.

Still referring to FIG. 11, keel cooler 200 according to an embodiment of the invention includes coolant tubes 250, each having a generally rectangular parallelepiped construction, and which may be the same as previously described coolant tubes. Coolant tubes 250 include interior or inner coolant tubes 251 and exterior or outer coolant tubes 260. As shown in FIG. 11, and similar to those described earlier, inner coolant tubes 251 join header 230 through inclined surface (not shown), which is composed of fingers 242 inclined with respect to inner coolant tubes 251 and which define spaces to receive open end portions or ports 244 of inner coolant tubes 251. Outer coolant tubes 260 have outermost sidewalls 261, part of which are also the sidewalls of header 230. Outer coolant tubes also have an interior sidewall 263 with an orifice 231, which is provided as a coolant flow port for coolant flowing between the chamber of header 230 and outer coolant tubes 260.

Also as shown in FIG. 11 and according to a preferred embodiment of the invention, coolant tubes 250 (including inner coolant tubes 251 and/or outer coolant tubes 260) include a plurality of turbulence enhancers 270. Turbulence enhancers 270 provide the same means for enhancing turbulence of the coolant to improve heat transfer without substantially increasing pressure drop of the coolant as those turbulence enhancers described above. Accordingly, turbulence enhancers 270 may have the same structural configurations, arrangements, and/or attributes according to previously described embodiments of turbulence enhancers, and are similarly not limited to the particular structures described. Certain non-limiting embodiments of turbulence enhancers 270 may take physical form in the geometric turbulator configurations, turbulator patterns, spacing ratio (β) ranges, and turbulator size ranges described above with reference to the embodiments shown in FIGS. 5A-5B and FIGS. 9A-10B. Keel cooler 200 with header 230, having improved flow rate and flow distribution of the coolant into coolant tubes 250, could result in a very effective keel cooler for transferring heat without substantial pressure drop when incorporating turbulence enhancers 270. Such a keel cooler could significantly reduce the footprint of the keel cooler, as well as the costs associated with the keel cooler.

Figure 12:
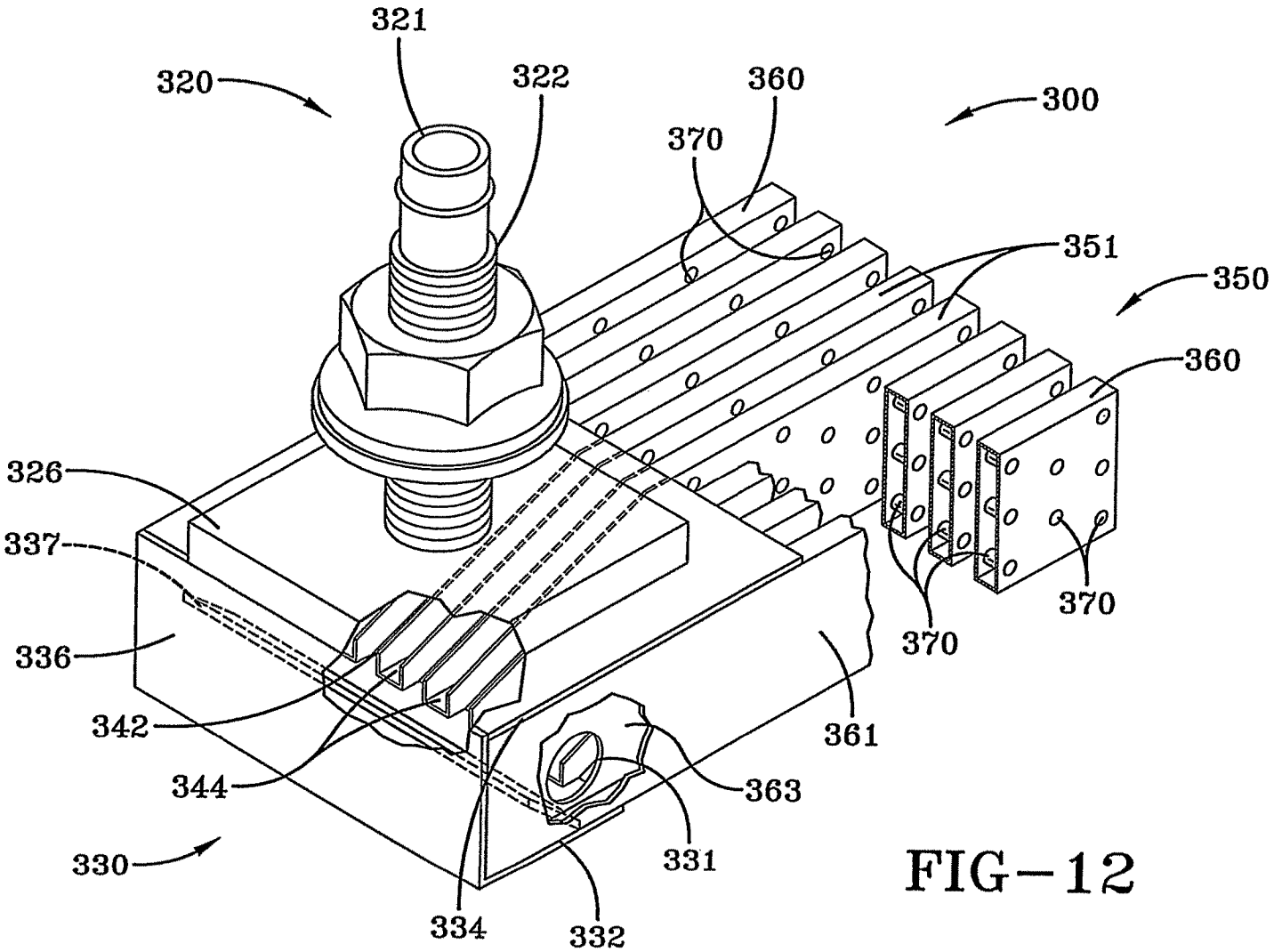
FIG. 12 is a perspective view of a portion of a keel cooler according to a preferred embodiment of the invention, including a partially cut-away view of square header with an angled wall, and a cut-away view of coolant tubes with turbulence enhancers.

Another embodiment of a keel cooler 300 according to the invention is shown in FIG. 12. Keel cooler 300 is the same as a keel cooler described in U.S. Pat. No. 6,896,037 (having the same assignee as the present application and being incorporated herein by reference in its entirety), except for the incorporation of turbulence enhancers 370 according to the present invention. Referring to FIG. 12, coolant tubes 350 (including inner coolant tubes 351 and/or outer coolant tubes 360) include a plurality of turbulence enhancers 370. Turbulence enhancers 370 provide the same means for enhancing turbulence of the coolant to improve heat transfer without substantially increasing pressure drop of the coolant as those turbulence enhancers described above. As such, turbulence enhancers 370 may have the same configurations, arrangements, and attributes of previous turbulence enhancers and are also not so limited to the specific structures disclosed. Certain non-limiting embodiments of turbulence enhancers 370 may take physical form in the geometric turbulator configurations, turbulator patterns, spacing ratio (β) ranges, and turbulator size ranges described above with reference to embodiments of FIGS. 5A-5B and FIGS. 9A-10B. Also as shown in FIG. 12, keel cooler 300 includes a header 330, including an upper wall 334, an angled wall 337 being integral (or attached by any other appropriate means such as welding) at its upper end with the upper portion of an end wall 336, which in turn is transverse to (and preferably perpendicular to) upper wall 334 and a bottom wall 332. Angled wall 337 may be integral with bottom wall 332 at its lower end, or also attached thereto by appropriate means, such as by welding. In other words, angled wall 337 is the hypotenuse of the triangular cross section formed by end wall 336, angled wall 337 and bottom wall 332. Coolant tubes 351 join header 330 through inclined surface (not shown), which is composed of fingers 342 inclined with respect to inner coolant tubes 351 and which define spaces to receive open end portions or ports 344 of inner coolant tubes 351. Outer coolant tubes 360 have outermost sidewalls 361, part of which are also the sidewalls of header 330. Outer coolant tubes also have interior sidewall 363 (with orifice 331), similar to the foregoing embodiments. A nozzle 320 having nipple 321 and connector 322 may be the same as those described earlier and are attached to header 330. A gasket 326, similar to and for the same purpose as gasket 126, is disposed on top of upper wall 334.

Figure 13:
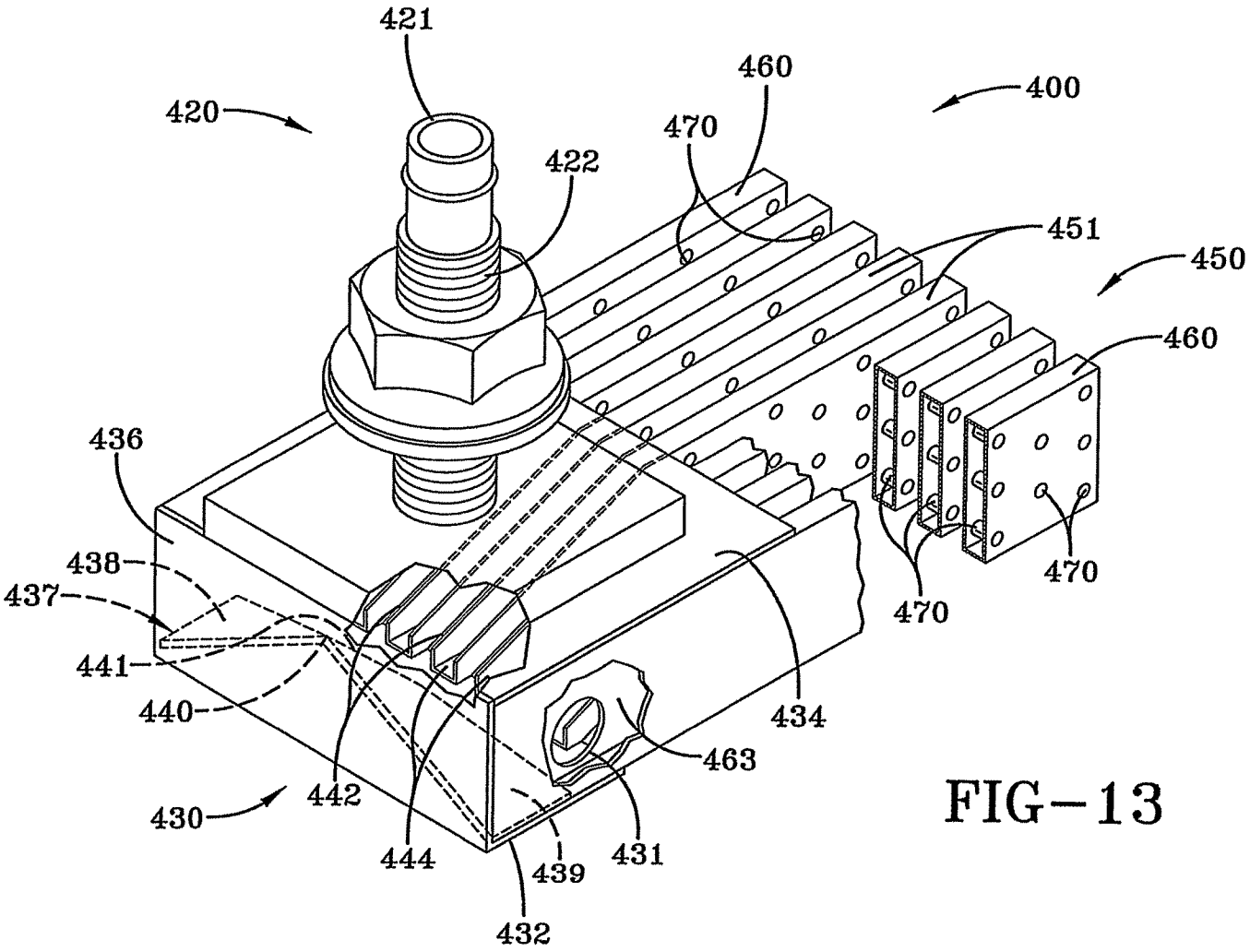
FIG. 13 is a perspective view of a portion of a keel cooler according to a preferred embodiment of the invention, including a partially cut-away view of square header with a fluid flow diverter, and a cut-away view of coolant tubes with turbulence enhancers.

FIG. 13 shows yet another embodiment of a keel cooler 400 according to the invention. Keel cooler 400 is also described in U.S. Pat. No. 6,896,037, except for the incorporation of turbulence enhancers 470 according to the present invention. Referring to FIG. 13, coolant tubes 450 (including inner coolant tubes 451 and/or outer coolant tubes 460) comprise a plurality of turbulence enhancers 470, which provide the same means for enhancing turbulence of the coolant to improve heat transfer without substantially increasing pressure drop of the coolant as those turbulence enhancers previously described. Accordingly, turbulence enhancers 470 may have the same configurations, arrangements, and attributes of previous turbulence enhancers, but are not so limited to the specific structures disclosed. Certain non-limiting embodiments of turbulence enhancers 470 may take physical form in the geometric turbulator configurations, turbulator patterns, spacing ratio (β) ranges, and turbulator size ranges described above with reference to the embodiments of FIGS. 5A-5B and FIGS. 9A-10B. Also as shown in the embodiment of FIG. 13, keel cooler 400 includes a header 430, including an upper wall 434, a flow diverter or baffle 437, a bottom wall 432, and an end wall 436. End wall 436 is attached transverse to (and preferably perpendicular to) upper wall 434 and bottom wall 432 so that header 430 is essentially rectangular or square shaped. Flow diverter 437 comprises a first angled side or panel 438 and a second angled side or panel 439, both of which extend downwardly at a predetermined angle from an apex 440. Extending downwardly from apex 440 at an angle greater than 0° from the plane perpendicular to end wall 436 and less than 90° from that same plane is a spine 441 which ends at the plane of bottom wall 432 (if there is a bottom wall 432; otherwise spine 441 would end at a plane parallel to the lower horizontal walls of inner coolant tubes 451) and at or near the open ends 444 of a plurality of parallel coolant tubes 450. Also as with the previous embodiments, coolant tubes 451 join header 430 through inclined surface (not shown), which is composed of fingers 442 inclined with respect to inner coolant tubes 451 and which define spaces to receive open end portions 444 of inner coolant tubes 451. Outer coolant tubes 460 have outermost sidewalls 461, part of which are also the sidewalls of header 430. Outer coolant tubes 460 also have interior sidewall 463 with orifice 431, which is provided as a coolant flow port. A nozzle 420 having nipple 421 and connector 422, may be the same as those described earlier and are attached to the header 430.

Figure 14:
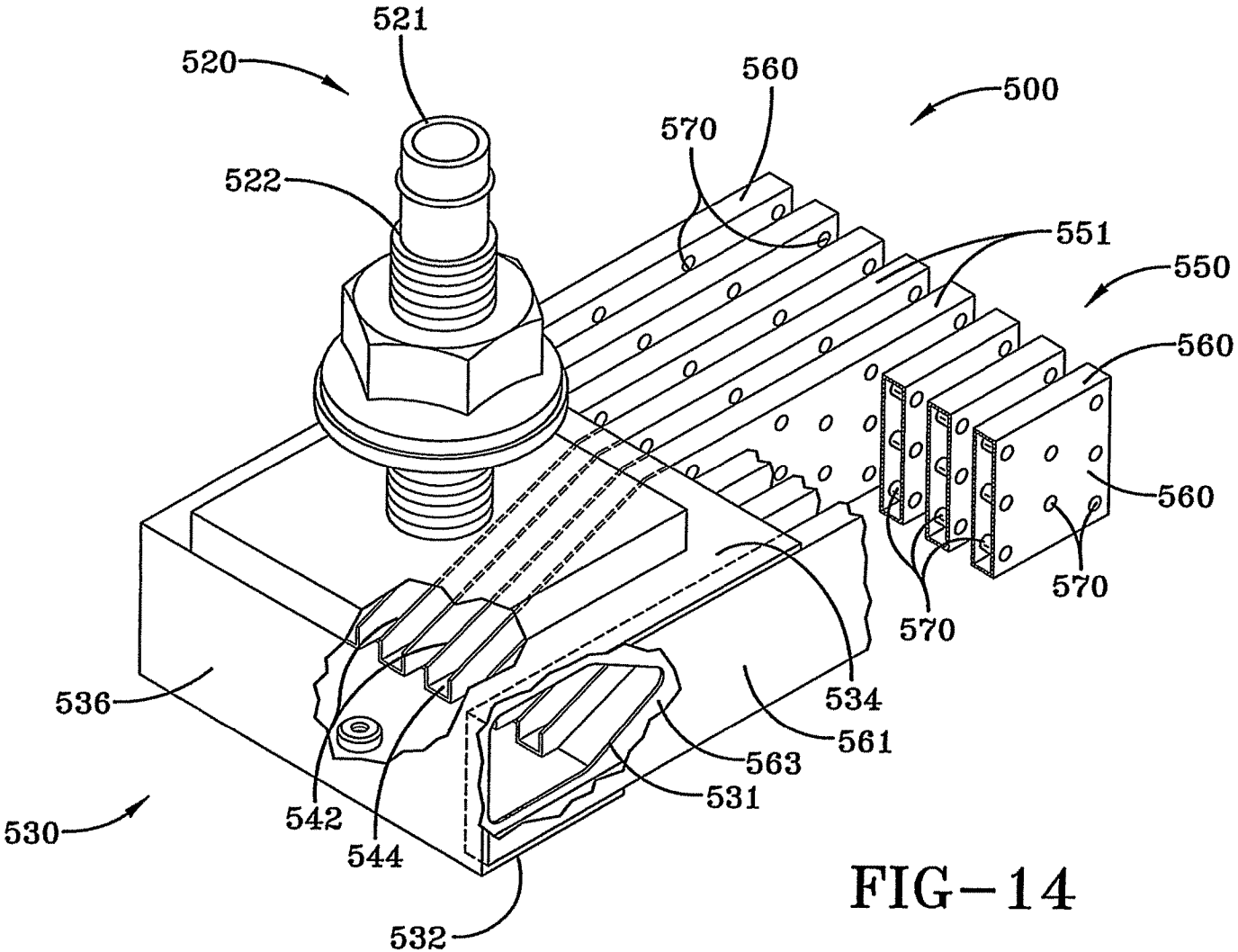
FIG. 14 is a perspective view of a portion of a keel cooler according to a preferred embodiment of the invention, including a partially cut-away view of square header with arrow-shaped orifice, and a cut-away view of coolant tubes with turbulence enhancers.

Turning to FIG. 14, another embodiment of a keel cooler 500 according to the invention is shown. Keel cooler 500 is the same as the embodiment of keel cooler 100 shown in FIG. 4, except for the shape of orifice 531. As shown in the embodiment of FIG. 14, orifice 531 may have an arrow-shaped configuration, or may have any other polygonal configuration adapted to the shape of header chamber, such as those orifice configurations described in U.S. Pat. No. 7,055,576 (incorporated herein by reference in its entirety). As shown in FIG. 14, keel cooler 500 includes a header 530 (similar to header 130), including an upper wall 534, an end wall 536, and a bottom wall 532. A nozzle 520 having nipple 521 and connector 522, may also be the same. Coolant tubes 551 join header 530 through inclined surface (not shown), which is composed of fingers 542 inclined with respect to interior coolant tubes 551 and which define spaces to receive open end portions 544 of inner coolant tubes 551. Outer coolant tubes 560 have outermost sidewalls 561, part of which are also the sidewalls of header 530. Outer coolant tubes 560 also have interior sidewall 563 with an orifice 531 provided as a coolant port. Coolant tubes 550 (including inner coolant tubes 551 and/or outer coolant tubes 560) include a plurality of turbulence enhancers 570, which provide the same means for enhancing turbulence of the coolant to improve heat transfer without substantially increasing pressure drop as previously described turbulence enhancers, and may include certain configurations, arrangements and attributes as described, but without being limited thereto. Certain non-limiting embodiments of turbulence enhancers 570 may also take physical form in the geometric turbulator configurations, turbulator patterns, and ranges thereof, as described with reference to embodiments of FIGS. 5A-5B and FIGS. 9A-10B.

Figure 15:
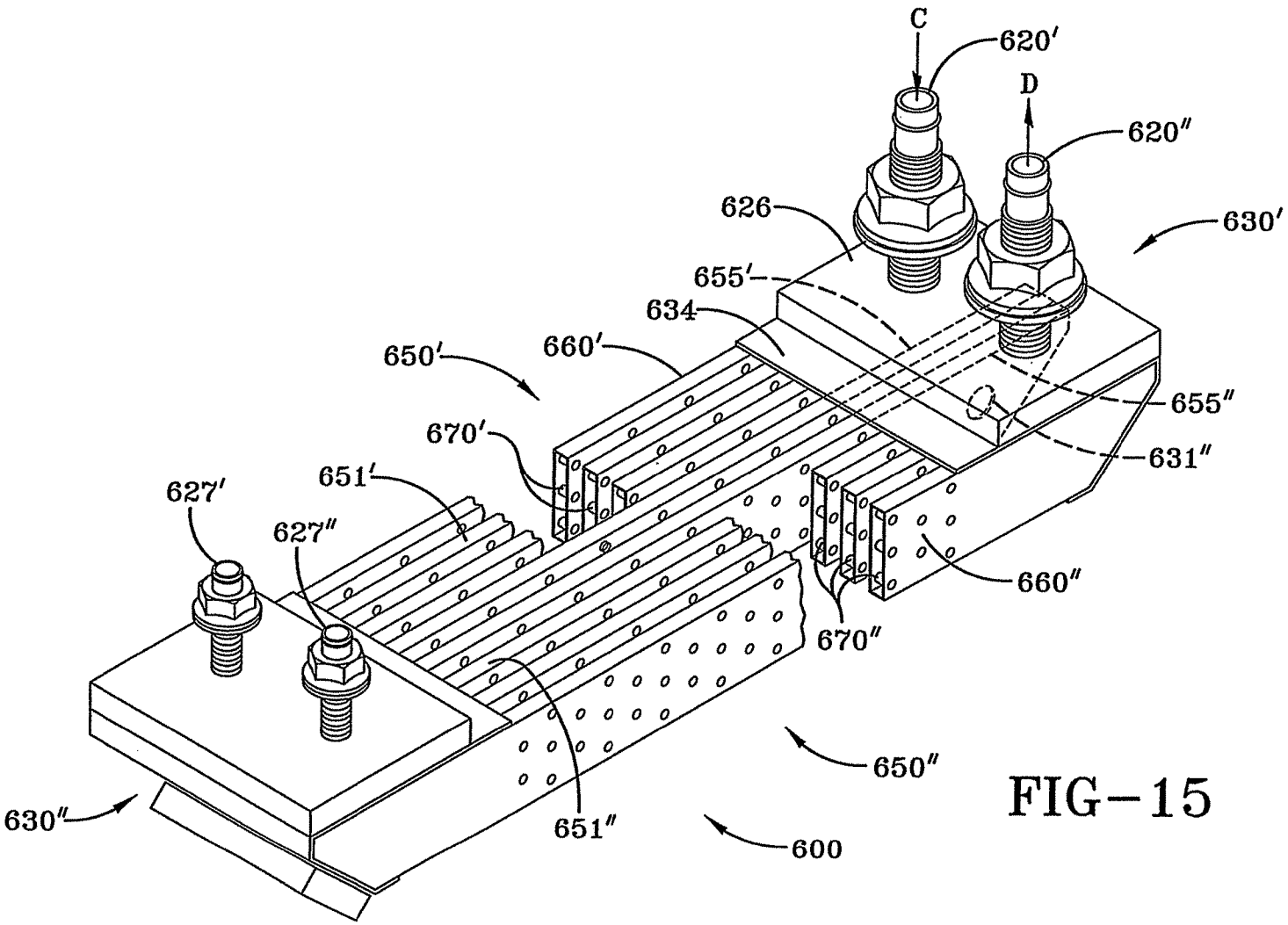
FIG. 15 is a perspective view of a two-pass keel cooler according to a preferred embodiment of the invention, including a cut-away view of coolant tubes with turbulence enhancers.

It should also be understood that the importance and function of turbulence enhancers or turbulators according to the present invention may have advantages in other keel cooler systems as well. Referring to FIG. 15, a two-pass keel cooler 600 according to an embodiment of the invention is shown. Keel cooler 600 is also described in U.S. Pat. No. 6,575,227, except for the incorporation of turbulence enhancers 670', 670" according to the present invention. As shown, keel cooler 600 has two sets of coolant flow tubes 650', 650", a header 630' and an opposite header 630". Header 630' has an inlet nozzle 620' and an outlet nozzle 620", which extend through a gasket 626. Gasket(s) 626 is located on top of upper wall 634 of header 630'. The other header 630" has no nozzles, but rather has one or two stud bolt assemblies 627', 627" for connecting the portion of the keel cooler which includes header 630" to the hull of the vessel. The hot coolant from the engine or generator of the vessel enters nozzle 620' as shown by arrow C, and the cooled coolant returns to the engine from header 630' through outlet nozzle 620" shown by the arrow D. Inner coolant tubes 651', 651" are like inner coolant tubes 251 in FIG. 11. Outer coolant tubes 660', 660" are like outer coolant tubes 260 in FIG. 11, such that orifices (not shown) corresponding to orifice 231 directs coolant into outer coolant tube 660' and from outer coolant tube 660". In addition, a coolant tube 655' serves as a separator tube for delivering inlet coolant from header 630' to header 630", and it has an orifice (not shown) for receiving coolant for separator tube 655' under high pressure from a part of header 630'. Similarly, a coolant tube 655" which is the return separator tube for carrying coolant from header 630', also has an orifice 631" in header 630'.

An embodiment of two-pass keel cooler 600 shown in FIG. 15 has one set of coolant tubes 650' (including inner coolant tubes 651' and outer coolant tube 660') for carrying hot coolant from header 630' to header 630", where the direction of coolant flow is turned 180° by header 630", and the coolant enters a second set of coolant tubes 650" (including inner coolant tubes 651" and outer coolant tube 660") for returning the partially cooled coolant back to header 630', and subsequently through nozzle 620" to the engine or other heat source of the vessel. According to an object of the present invention, turbulence enhancers 670', 670", shown in the embodiment of FIG. 15, could improve the heat transfer of such two-pass keel coolers 600 without substantially increasing pressure drop. As with other embodiments, turbulence enhancers 670', 670" provide the same means for enhancing turbulence to improve heat transfer without substantial pressure drop, including certain configurations and arrangements, but not being limited thereto. Certain non-limiting embodiments of turbulence enhancers 670', 670" may also take physical form in the geometric turbulator configurations, turbulator patterns, and ranges thereof, as described with reference to embodiments of FIGS. 5A-5B and FIGS. 9A-10B. Keel cooler 600 shown in FIG. 15 has 8 coolant tubes. However, the two-pass system would be appropriate for any even number of tubes, especially for those with more than two tubes. There are presently keel coolers having as many as 24 tubes, but it is possible according to the present invention for the number of tubes to be increased even further. These can also be keel coolers with more than two passes. If the number of passes is even, both nozzles are located in the same header. If the number of passes is an odd number, there is one nozzle located in each header.

Figure 16:
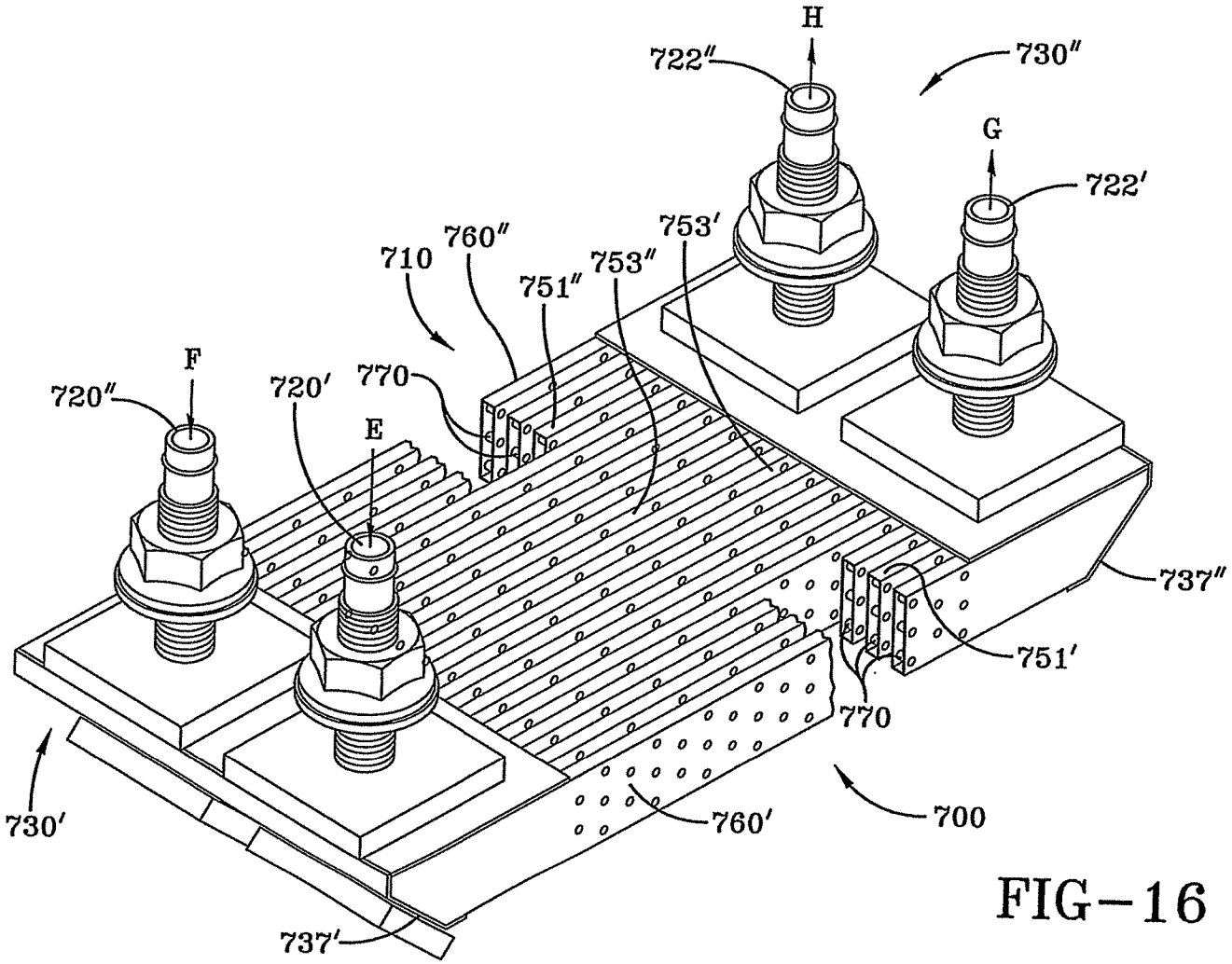
FIG. 16 is a perspective view of a multiple-systems-combined keel cooler having two single-pass portions according to a preferred embodiment of the invention, including a cut-away view of coolant tubes with turbulence enhancers.

Another embodiment of the present invention is shown in FIG. 16, which shows a multiple-systems-combined keel cooler 700 which has not been practically possible with some prior one-piece keel coolers. Multiple-systems-combined keel cooler 700 can be used for cooling two or more heat sources, such as two relatively small engines or an after cooler and a gear box in a single vessel. Although the embodiment shown in FIG. 16 shows two keel cooler systems, there could be additional ones as well, depending on the situation. Thus, FIG. 16 shows an embodiment of multiple-systems-combined (two single-pass) keel cooler 700, including two identical headers 730' and 730" having inlet nozzles 720', 720", respectively, and outlet nozzles 722', 722" respectively. Both nozzles in respective headers 730' and 730" could be reversed with respect to the direction of flow in them, or one could be an inlet and the other could be an outlet nozzle for the respective headers. The direction of the coolant flow through the nozzles is shown respectively by arrows E, F, G and H. Keel cooler 700 has beveled closed end portions 737', 737" as discussed in an earlier embodiment.

Further as shown in the embodiment of FIG. 16, a set of coolant tubes 751' for conducting coolant between nozzles 720' and 722' commence with outer tube 760' and terminate with separator tube 753', and a set of tubes 751" extending between nozzles 720" and 722", commencing with outer coolant tube 760" and terminating with separator tube 753". Outer coolant tubes 760', 760" have orifices (not shown) at their respective inner walls which are similar in size and position to those shown in the previously described embodiments of the invention. The walls of coolant tubes 753' and 753" which are adjacent to each other are solid, and extend between the end walls of headers 730' and 730". These walls thus form system separators, which prevent the flow of coolant across these walls, so that the tubes 751' form, in effect, one keel cooler, and tubes 751" form, in effect, a second keel cooler (along with their respective headers). Keel cooler 700 includes turbulence enhancers 770', 770", which provide the same means for enhancing turbulence to improve heat transfer without substantially increasing pressure drop according to previous embodiments. Turbulence enhancers 770', 770" can include certain geometric turbulator configurations and turbulator patterns, as described above, including the ranges thereof, but without being specifically limited thereto. It should be understood that this type of keel cooler can be more economical than having two separate keel coolers, since there is a savings by only requiring two headers, rather than four.

Figure 17:
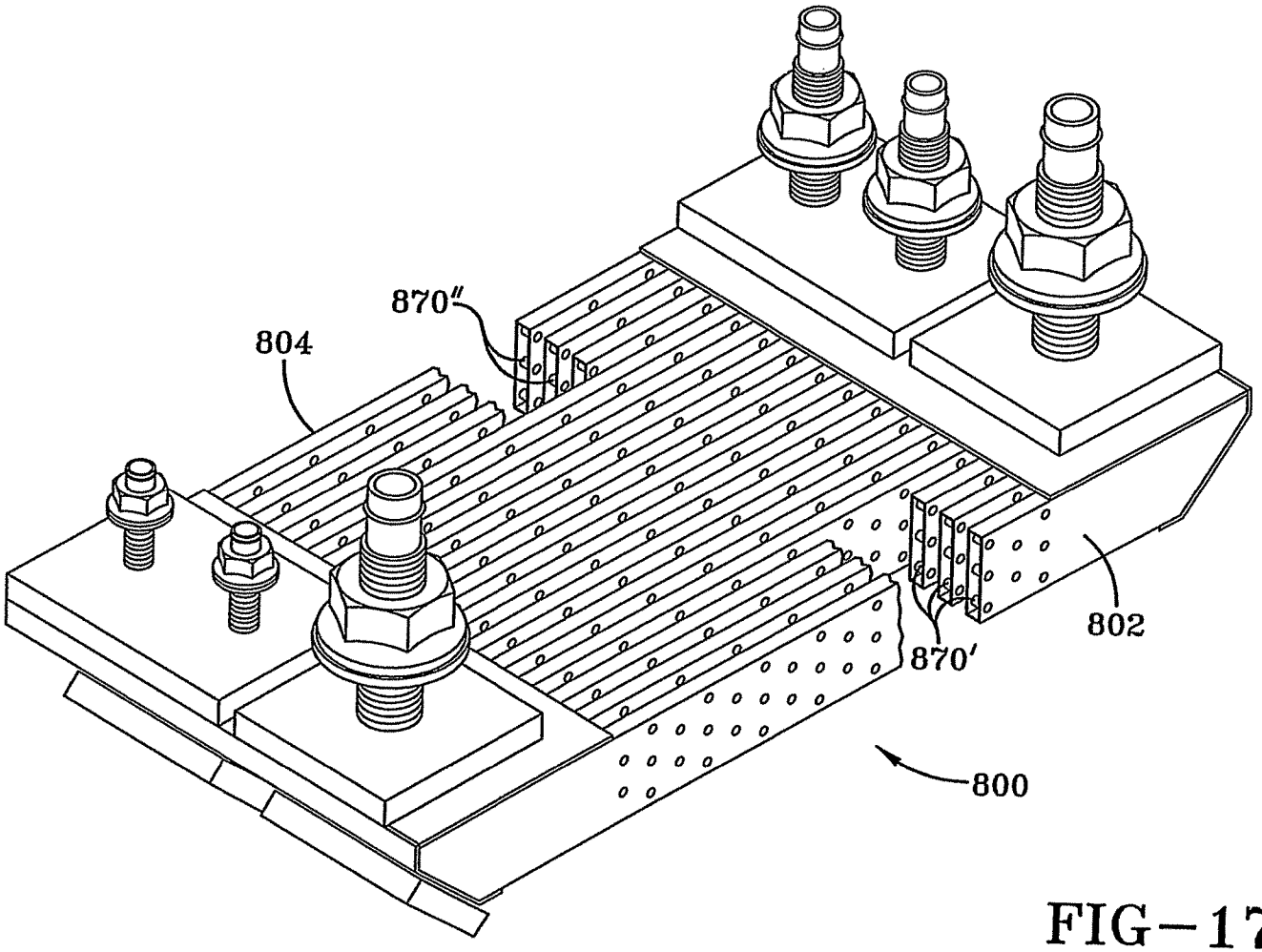
FIG. 17 is a perspective view of a keel cooler having a single-pass portion and a double-pass portion according to a preferred embodiment of the invention, including a cut-away view of coolant tubes with turbulence enhancers.

Multiple keel coolers can be combined in various combinations. For example, there can be two or more one-pass systems as shown in FIG. 16. However, there can also be one or more single-pass systems and one or more double-pass systems in combination as shown in the embodiment of FIG. 17. In FIG. 17, an embodiment of keel cooler 800 is depicted having a single-pass keel cooler portion 802, and a double-pass keel cooler portion 804, each portion having turbulence enhancers 870', 870" as previously described according to embodiments of the present invention. Keel cooler portion 802 functions as that described with reference to the embodiment of FIG. 11, and keel cooler portion 804 functions as that described with reference to the embodiment of FIG. 15. FIG. 17 shows a double-pass system for one heat exchanger, and additional double-pass systems could be added as well.

Figure 18:
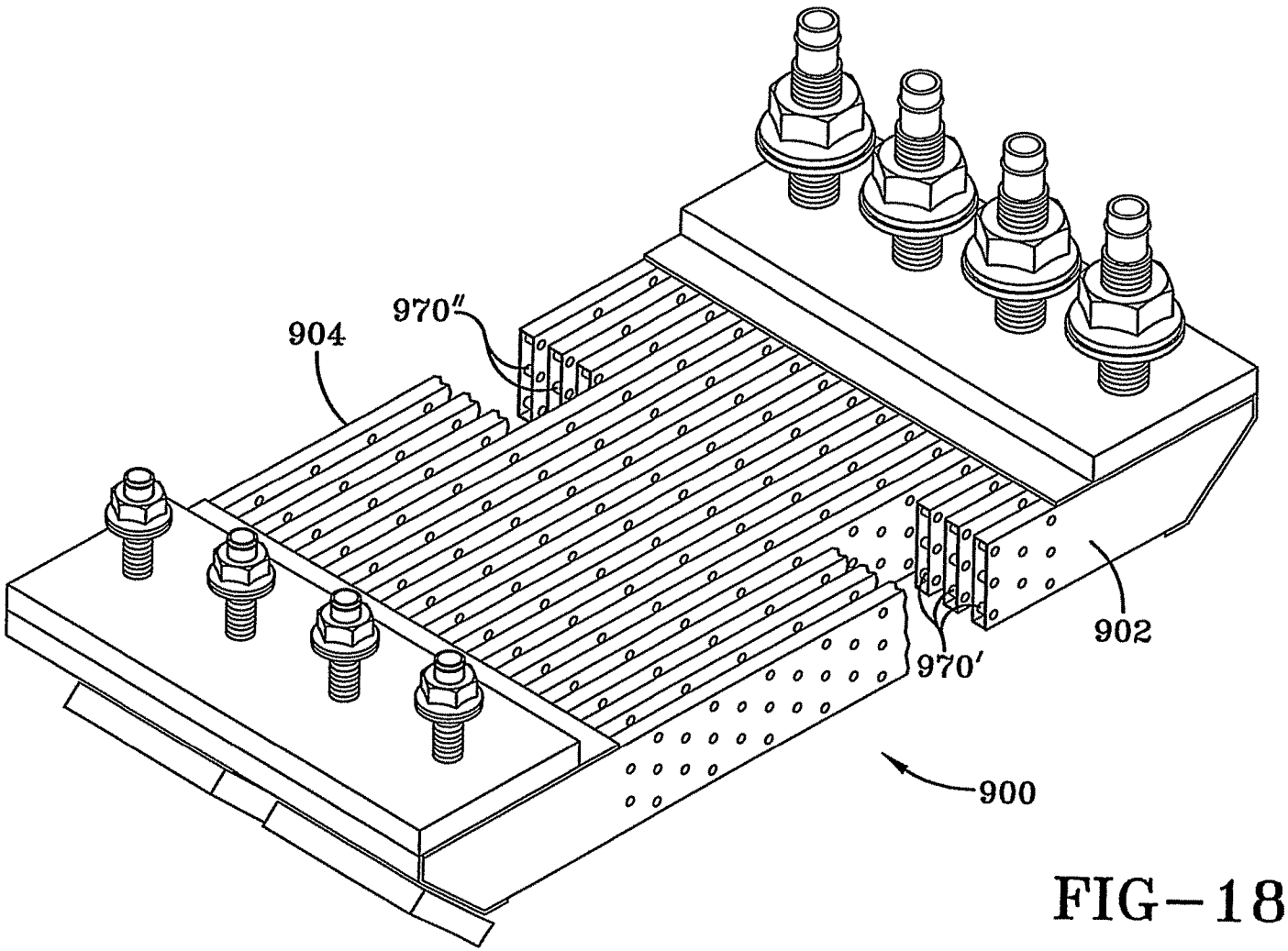
FIG. 18 is a perspective view of a keel cooler having two double-pass portions according to a preferred embodiment of the invention, including a cut-away view of coolant tubes with turbulence enhancers.

FIG. 18 shows an embodiment of keel cooler 900 having two double-pass keel cooler portions 902, 904, which can be identical or have different capacities, and each portion having turbulence enhancers 970', 970" according to preferred embodiments of the invention. Each portion functions as described above with respect to the embodiment of FIG. 15. Multiple-coolers-combined is a powerful feature not found in prior one-piece keel coolers. The modification of the special separator/tube design improves heat transfer and flow distribution while minimizing pressure drop concerns, and the incorporation of turbulence enhancers could lead to a very effective keel cooler system.

The invention has been described in detail with particular reference to the preferred embodiments thereof, with variations and modifications which may occur to those skilled in the art to which the invention pertains.

The invention claimed is:

1. A keel cooler assembly for use on a marine vessel, said keel cooler assembly exchanging heat with an internal liquid coolant flowing through the keel cooler assembly, said keel cooler assembly comprising:

a header;

at least one liquid coolant tube extending in a longitudinal direction from said header, said at least one liquid coolant tube comprising:

at least one inlet for ingress of the liquid coolant;

at least one outlet for egress of the liquid coolant;

an elongated body portion extending between said at least one inlet and said at least one outlet, said elongated body portion including an interior surface forming an internal channel for allowing flow of the liquid coolant in a longitudinal direction along a length of said elongated body portion; and a means for enhancing the turbulence of the liquid coolant flowing through said at least one liquid coolant tube for improving heat transfer without substantially increasing pressure drop of the liquid coolant above an identical at least one liquid coolant tube lacking said means for enhancing turbulence;

wherein said means for enhancing turbulence comprises a plurality of turbulence enhancers extending inwardly into said internal channel from said elongated body portion interior surface, said plurality of turbulence enhancers being arranged in a predetermined pattern and each of said plurality of turbulence enhancers includes a body portion extending inwardly into said internal channel from said liquid coolant tube elongated body portion interior surface;

wherein said predetermined pattern comprises a plurality of longitudinal rows of said turbulence enhancers, said plurality of longitudinal rows of said turbulence enhancers including a first longitudinal spacing ($X_L$) between respective longitudinally adjacent turbulence enhancers located in the same longitudinal row, and a second transverse spacing ($X_H$) between respective transversely adjacent turbulence enhancers located in adjacent longitudinal rows; and wherein said respective longitudinally adjacent turbulence enhancers located in the same longitudinal rows are transversely offset in an alternating staggered configuration.

2. The keel cooler assembly of claim 1 wherein a spacing ratio ($\beta$) of said first longitudinal spacing ($X_L$) to said second transverse spacing ($X_H$) is greater than about 3.5 for generating and propagating turbulent vortexes in the liquid coolant for enhancing liquid coolant mixing and improving heat transfer without substantially increasing pressure drop of the liquid coolant.

3. The keel cooler assembly of claim 1 wherein a spacing ratio (β) of said first longitudinal spacing ($X_L$) to said second transverse spacing ($X_H$) is in the range between about 1.0 and 7.0 for generating turbulent wakes in the liquid coolant for enhancing eddying motion and improving heat transfer without substantially increasing pressure drop of the liquid coolant.

4. The keel cooler assembly of claim 1 wherein said body portion being disposed in a bulk region of the liquid coolant when the liquid coolant is flowing through said at least one liquid coolant tube for generating turbulent wakes in said bulk region for enhancing eddying motion and improving heat transfer without substantially increasing pressure drop of the liquid coolant above an identical keel cooler assembly lacking said plurality of turbulence enhancers.

5. The keel cooler assembly of claim 1 wherein:

said header comprises an upper wall, an end wall, a bottom wall, opposing sidewalls, and an inclined surface operatively connecting said upper wall, bottom wall and sidewalls; and said at least one liquid coolant tube comprises at least one outer liquid coolant tube configured as a rectangular parallelepiped comprising opposing upper and lower walls, and opposing first and second sidewalls transverse to said opposing upper and lower walls, said first and second sidewalls operatively connecting said upper and lower walls for forming said internal channel, said first sidewall being an interior sidewall and said second sidewall being an outermost sidewall;

wherein said outermost sidewalls extend between the side portions of said header upper wall and said header lower wall for forming said header sidewalls, and wherein said interior sidewalls separate a header chamber from said header sidewalls, said interior sidewalls including said at least one inlet configured as an orifice located between said respective outermost sidewalls and said header chamber for allowing flow of the liquid coolant through said orifice and along said internal channel.

6. The keel cooler assembly of claim 1 wherein said means for enhancing turbulence comprises a means for generating turbulent wakes in the liquid coolant for enhancing eddying motion and improving heat transfer without substantially increasing pressure drop of the liquid coolant above an identical at least one liquid coolant tube lacking said means for generating turbulent wakes.

7. The keel cooler assembly of claim 1 wherein said means for enhancing turbulence comprises a means for generating turbulent vortexes in the liquid coolant for enhancing liquid coolant mixing and improving heat transfer without substantially increasing pressure drop of the liquid coolant above an identical at least one liquid coolant tube lacking said means for generating turbulent vortexes.

8. The keel cooler assembly of claim 7, wherein:

said header comprises an upper wall, an end wall, a bottom wall, opposing sidewalls, and an inclined surface operatively connecting said upper wall, bottom wall and sidewalls; and said at least one liquid coolant tube comprises an inner liquid coolant tube, said elongated body portion including at least one open end portion having a rectangular cross-sectional configuration, said at least one open end portion defining at least one inlet for ingress of the liquid coolant, said at least one inlet being received by at least one spacing in said inclined surface of said header.

9. The keel cooler assembly of claim 1 wherein said means for enhancing turbulence of the liquid coolant for improving heat transfer without substantially increasing pressure drop of the liquid coolant above an identical at least one liquid coolant tube lacking said means for enhancing turbulence comprises at least one of (i) a means for generating turbulent wakes in the liquid coolant for enhancing eddying motion, and (ii) a means for generating turbulent vortexes in the liquid coolant for enhancing liquid coolant mixing.

10. The keel cooler assembly of claim 1 wherein:

said header comprises an upper wall, an end wall, a bottom wall, opposing sidewalls, and an inclined surface operatively connecting said upper wall, bottom wall and sidewalls; and said at least one liquid coolant tube comprises at least one inner liquid coolant tube configured as a rectangular parallelepiped comprising opposing upper and lower walls, and opposing first and second sidewalls transverse to said opposing upper and lower walls, said first and second sidewalls operatively connecting said upper and lower walls for forming said internal channel, wherein said elongated body portion includes at least one open end portion being received by at least one spacing in said inclined surface of said header, said at least one open end portion having a rectangular cross-sectional configuration defining said at least one inlet.

11. A keel cooler assembly for use on a marine vessel, said keel cooler assembly exchanging heat with an internal liquid coolant flowing through the keel cooler assembly, said keel cooler assembly comprising:

a header comprising:

a header upper wall;

a header end wall;

a header bottom wall opposite said header upper wall;

opposing header sidewalls extending between said header upper wall and said header bottom wall; and an inclined surface operatively connecting said header upper wall, said header bottom wall and said header sidewalls; and at least two liquid coolant tubes extending in a longitudinal direction from said header, said at least two liquid coolant tubes comprising:

an inner liquid coolant tube; and an outer coolant tube;

each of said inlet coolant tubes comprising:

an elongated body portion comprising an interior surface forming an internal channel for allowing flow of the liquid coolant in a longitudinal direction along a length of said elongated body portion, and at least one open end portion having a rectangular cross-sectional configuration, said at least one open end portion defining at least one inlet for ingress of the liquid coolant, said at least one inlet being received by at least one spacing in said inclined surface of said header;

each of said at least two liquid coolant tubes comprising:

a plurality of turbulators extending inwardly into said internal channel from said elongated body portion interior surface and being configured to interact with the liquid coolant for enhancing the turbulence of the liquid coolant for improving heat transfer without substantially increasing pressure drop of the liquid coolant above an identical at least one liquid coolant tube lacking said turbulators;

wherein each of said at least two liquid coolant tubes is configured as a rectangular parallelepiped, said at least one liquid coolant tube comprising an upper coolant tube wall, an opposing lower coolant tube wall, and opposing first and second coolant tube sidewalls transverse to said opposing upper and lower walls, said opposing first and second coolant tube sidewalls operatively connecting each of said upper and lower coolant tube walls for forming said internal channel;

wherein said first coolant tube sidewall is an interior coolant tube sidewall and said second coolant tube sidewall is an outermost coolant tube sidewalk;

wherein said outermost coolant tube sidewalls extend between the side portions of said header upper wall and said header lower wall for forming said header sidewalls, and wherein said coolant tube interior sidewalls separate a header chamber from said header sidewalls, said coolant tube interior sidewalls having at least one inlet configured as an orifice located between said respective outermost coolant tube sidewalls and said header chamber for allowing flow of the liquid coolant through said orifice and along said internal channel;

wherein said plurality of turbulators are arranged in a predetermined pattern, said predetermined pattern comprising a plurality of longitudinal rows of said turbulators, said plurality of longitudinal rows of said turbulators including a first longitudinal spacing ($X_L$) between respective longitudinally adjacent turbulators located in the same longitudinal row, and a second transverse spacing ($X_H$) between respective transversely adjacent turbulators located in adjacent longitudinal rows; and wherein said respective longitudinally adjacent turbulence enhancers located in the same longitudinal rows are transversely offset in an alternating staggered configuration.

12. The keel cooler assembly of claim 11 wherein said turbulators are operatively connected to said at least one liquid coolant tube elongated body portion interior surface by at least one of brazing, soldering, welding, and integrally forming.

13. The keel cooler assembly of claim 11 wherein each of said plurality of turbulators includes a body portion extending inwardly into said internal channel from said liquid coolant tube elongated body portion interior surface, said body portion being disposed in a bulk region of the liquid coolant when the liquid coolant is flowing through said at least one liquid coolant tube for generating turbulent wakes in said bulk region for enhancing eddying motion and improving heat transfer without substantially increasing pressure drop of the liquid coolant above an identical at least one liquid coolant tube lacking turbulators.

14. The keel cooler assembly according to claim 13 wherein in said respective liquid coolant tubes, said upper coolant tube wall is adjacent to each of said opposing first and second coolant tube sidewalls and said upper coolant tube wall intersects said first and second coolant tube walls at upper liquid coolant wall intersections, and said lower coolant tube wall is adjacent to each of said opposing first and second sidewalls and said lower coolant wall intersects said first and second coolant tube walls at lower liquid coolant tube wall intersections, and wherein said respective turbulator body portions extend from a selected one of said respective upper coolant tube wall, lower coolant tube wall, first coolant tube sidewall, second coolant tube sidewall, upper liquid coolant wall intersection and lower liquid coolant wall intersection, to a respective different liquid coolant tube wall and liquid coolant tube wall intersection.

15. The keel cooler assembly of claim 13 wherein said respective turbulators comprise an elongated body portion, said respective elongated body portions being arranged substantially orthogonally to at least one of said respective opposing walls.

16. The keel cooler assembly of claim 13 wherein each of said plurality of turbulators includes an elongated turbulator body portion having a cross-sectional configuration selected from the group consisting of round, ellipsoid, oval, rectangular, square, triangular, wing-shaped, airfoil-shaped, polygonal, and an irregular configuration.

17. The keel cooler assembly according to claim 11 wherein said respective turbulator body portions extend from one of said respective upper wall, lower wall, first sidewall, and second sidewall to a different one of said upper wall, lower wall, first sidewall and second sidewall of said at least one coolant tube.

18. The keel cooler assembly of claim 11 wherein said plurality of turbulators comprises:

a first plurality of turbulators, each of said first plurality of turbulators including a first cross-sectional configuration; and a second plurality of turbulators, each of said second plurality of turbulators including a second cross-sectional configuration different from said first cross-sectional configuration.

19. A liquid coolant tube for use in a keel cooler, said liquid coolant tube exchanging heat with an internal liquid coolant flowing through the liquid coolant tube, said liquid coolant tube extending in a longitudinal direction from a header, the header including an upper wall, an end wall, a bottom wall, opposing sidewalls, and an inclined surface operatively connecting said upper wall, bottom wall and sidewalls, said liquid coolant tube comprising:

an inner liquid coolant tube;

an elongated body portion comprising:

an interior surface forming an internal channel for allowing flow of the liquid coolant in a longitudinal direction along a length of said elongated body portion;

opposing upper and lower walls, and opposing first and second sidewalls transverse to said opposing upper and lower walls, said first and second sidewalls operatively connecting said upper and lower walls for forming said internal channel; said elongated body portion having a rectangular cross-sectional configuration; and at least one open end portion having a rectangular cross-sectional configuration, said at least one open end portion defining at least one inlet for ingress of the liquid coolant, said at least one inlet being received by at least one spacing in the inclined surface of the header;

a plurality of turbulators extending inwardly into said internal channel from said elongated body portion interior surface and being configured to interact with the liquid coolant for enhancing the turbulence of the liquid coolant without substantially increasing pressure drop of the liquid coolant above an identical at least one liquid coolant tube lacking said turbulators;

wherein each of said plurality of turbulators comprises an elongated body portion extending between at least one of (i) said opposing first and second sidewalls and (ii) said opposing upper and lower walls, said respective turbulator elongated body portions having opposing end portions being operatively connected to each of said respective opposing walls;

wherein said plurality of turbulators are arranged in a predetermined pattern, said predetermined pattern comprising a plurality of longitudinal rows of said turbulators, said plurality of longitudinal rows of said turbulators including a first longitudinal spacing ($X_L$) between respective longitudinally adjacent turbulence enhancers located in the same longitudinal row, and a second transverse spacing ($X_H$) between respective transversely adjacent turbulence enhancers located in adjacent longitudinal rows.

20. The liquid coolant tube of claim 19 wherein said liquid coolant tube further comprises an outer liquid coolant tube, said first sidewall being an interior sidewall and said second sidewall being an outermost sidewall;

wherein said outermost sidewalls extend between the side portions of the header upper wall and the header lower wall for forming the header sidewalls, and wherein said interior sidewalls separate a header chamber from the header sidewalls, said interior sidewalls having at least one inlet configured as an orifice located between said respective outermost sidewalls and said header chamber for allowing flow of the liquid coolant through said orifice and along said internal channel.

21. The liquid coolant tube of claim 19 being constructed of a copper-nickel alloy, wherein said turbulators are operatively connected to said at least one liquid coolant tube elongated body portion interior surface by at least one of the group consisting of brazing, soldering, welding, and integrally forming.

22. A keel cooler assembly for use on a marine vessel, said keel cooler assembly exchanging heat with an internal liquid coolant flowing through the keel cooler assembly, said keel cooler assembly comprising:

a header;

at least one liquid coolant tube extending in a longitudinal direction from said header, said at least one liquid coolant tube comprising:

at least one inlet for ingress of the liquid coolant;

at least one outlet for egress of the liquid coolant;

an elongated body portion configured as a rectangular parallelepiped, said elongated body portion extending between said at least one inlet and said at least one outlet, said elongated body portion including an interior surface forming an internal channel for allowing flow of the liquid coolant in a longitudinal direction along a length of said elongated body portion; and a means for enhancing turbulence of the liquid coolant flowing through said at least one liquid coolant tube for improving heat transfer without substantially increasing pressure drop of the liquid coolant above an identical at least one liquid coolant tube lacking said means for enhancing turbulence;

wherein said means for enhancing turbulence comprises a plurality of turbulence enhancers extending inwardly into said internal channel from said elongated body portion interior surface.

23. The keel cooler assembly of claim 22 wherein said means for enhancing turbulence comprises a means for extending inwardly from said interior surface to said internal channel for generating turbulent wakes in the liquid coolant for enhancing eddying motion and improving heat transfer without substantially increasing pressure drop of the liquid coolant above an identical at least one liquid coolant tube lacking said means for generating turbulent wakes.

24. The keel cooler assembly of claim 22 wherein said means for enhancing turbulence comprises a means for extending inwardly from said interior surface to said internal channel for generating turbulent vortexes in the liquid coolant for enhancing liquid coolant mixing and improving heat transfer without substantially increasing pressure drop of the liquid coolant above an identical at least one liquid coolant tube lacking said means for generating turbulent vortexes.

25. The keel cooler assembly of claim 22 wherein said means for enhancing turbulence of the liquid coolant for improving heat transfer without substantially increasing pressure drop of the liquid coolant above an identical at least one liquid coolant tube lacking said means for enhancing turbulence comprises at least one of (i) a means for extending inwardly from said interior surface to said internal channel for generating turbulent wakes in the liquid coolant for enhancing eddying motion, and (ii) a means for generating turbulent vortexes in the liquid coolant for enhancing liquid coolant mixing.

26. The keel cooler assembly of claim 22 wherein said plurality of turbulence enhancers being arranged in a predetermined pattern.

27. The keel cooler assembly of claim 26 wherein each of said plurality of turbulence enhancers includes a body portion extending inwardly into said internal channel from said liquid coolant tube elongated body portion interior surface, said body portion being disposed in a bulk region of the liquid coolant when the liquid coolant is flowing through said at least one liquid coolant tube for generating turbulent wakes in said bulk region for enhancing eddying motion and improving heat transfer without substantially increasing pressure drop of the liquid coolant above an identical keel cooler assembly lacking said plurality of turbulence enhancers.

28. The keel cooler assembly of claim 22 wherein:

said header comprises an upper wall, an end wall, a bottom wall, opposing sidewalls, and an inclined surface operatively connecting said upper wall, bottom wall and sidewalls; and said at least one liquid coolant tube comprises at least one outer liquid coolant tube configured as a rectangular parallelepiped comprising opposing upper and lower walls, and opposing first and second sidewalls transverse to said opposing upper and lower walls, said first and second sidewalls operatively connecting said upper and lower walls for forming said internal channel, said first sidewall being an interior sidewall and said second sidewall being an outermost sidewall;

wherein said outermost sidewalls extend between the side portions of said header upper wall and said header lower wall for forming said header sidewalls, and wherein said interior sidewalls separate a header chamber from said header sidewalls, said interior sidewalls including said at least one inlet configured as an orifice located between said respective outermost sidewalls and said header chamber for allowing flow of the liquid coolant through said orifice and along said internal channel.

29. A keel cooler assembly for use on a marine vessel, said keel cooler assembly exchanging heat with an internal liquid coolant flowing through the keel cooler assembly, said keel cooler assembly comprising:

a header;

at least one liquid coolant tube extending in a longitudinal direction from said header, said liquid coolant tube comprising:

an elongated body portion comprising an interior surface forming an internal channel for allowing flow of the liquid coolant in a longitudinal direction along a length of said elongated body portion; and a plurality of turbulators extending inwardly into said internal channel from said elongated body portion interior surface and being configured to interact with the liquid coolant for enhancing the turbulence of the liquid coolant for improving heat transfer without substantially increasing pressure drop of the liquid coolant above an identical at least one liquid coolant tube lacking said turbulators.

30. The keel cooler assembly of claim 29, wherein said at least one liquid coolant tube is configured as a rectangular parallelepiped, said at least one liquid coolant tube comprising opposing upper and lower walls, and opposing first and second sidewalls transverse to said opposing upper and lower walls, said first and second sidewalls operatively connecting said upper and lower walls for forming said internal channel.

31. The keel cooler assembly of claim 30, wherein each of said plurality of turbulators comprises an elongated body portion extending between at least one of (i) said opposing first and second sidewalls and (ii) said opposing upper and lower walls, said respective turbulator elongated body portions having opposing end portions being operatively connected to each of said respective opposing walls.

32. The keel cooler assembly of claim 31, wherein said respective turbulator elongated body portions are configured as at least one of:

a solid cylinder having a round cross-section for enhancing the turbulence of the liquid coolant for improving heat transfer without substantially increasing pressure drop above an identical at least one liquid coolant tube lacking said turbulators;

a hollow cylinder having a round cross-section, said hollow cylinder having round openings on said opposing end portions with an interior channel formed there between for allowing flow of ambient fluid through said turbulator interior channel for increasing heat transfer of the liquid coolant flowing through said liquid coolant tube and around said turbulator elongated body portion; and a solid bar having a wing-shaped cross-section for directing turbulent wakes of the liquid coolant in a predetermined direction for increasing heat transfer without substantially increasing pressure drop of the liquid coolant above an identical at least one liquid coolant tube lacking said turbulators.

33. The keel cooler assembly of claim 30, wherein said plurality of turbulators are arranged in a predetermined pattern selected from the group consisting of: symmetrical, asymmetrical, parallelogram, rectangular, square, diamond, triangular, polygonal, spiral, undulating, sinuous, irregular, and random.

34. The keel cooler assembly of claim 30, wherein said plurality of turbulators are arranged in a predetermined pattern, said predetermined pattern comprising a plurality of longitudinal rows of said turbulators, said plurality of longitudinal rows of said turbulators including a first longitudinal spacing ($X_L$) between respective longitudinally adjacent turbulators located in the same longitudinal row, and a second transverse spacing ($X_H$) between respective transversely adjacent turbulators located in adjacent longitudinal rows.

35. The keel cooler assembly of claim 34, wherein said respective longitudinally adjacent turbulators located in the same longitudinal rows are transversely offset in an alternating staggered configuration.

36. The keel cooler assembly of claim 35, wherein a spacing ratio (β) of said first longitudinal spacing ($X_L$) to said second transverse spacing ($X_H$) is in the range between about 1.0 and 7.0 for generating turbulent wakes in the liquid coolant for enhancing eddying motion and improving heat transfer without substantially increasing pressure drop of the liquid coolant above an identical at least one liquid coolant tube lacking said turbulators.

37. The keel cooler assembly of claim 35, wherein a spacing ratio (β) of said first longitudinal spacing ($X_L$) to said second transverse spacing ($X_H$) is greater than about 3.5 for generating and propagating turbulent vortexes in the liquid coolant for enhancing liquid coolant mixing and improving heat transfer without substantially increasing pressure drop of the liquid coolant above an identical at least one liquid coolant tube lacking said turbulators.

38. The keel cooler assembly of claim 37, wherein each of said plurality of turbulators comprises opposing turbulator end portions and an elongated body portion extending between said opposing turbulator end portions, said respective turbulator elongated body portions extending between said opposing first and second sidewalls, said opposing turbulator end portions being operatively connected to each of said respective sidewalls, wherein:

said respective turbulator elongated body portions are arranged orthogonally to each of said opposing first and second sidewalls; and wherein said respective turbulator elongated body portions are configured as least one of the group consisting of:

a solid cylinder having a round cross-section for enhancing the turbulence of the liquid coolant for improving heat transfer without substantially increasing pressure drop above an identical at least one liquid coolant tube lacking said turbulators;

a hollow cylinder having a round cross-section, said hollow cylinder having round openings on said opposing end portions with an interior channel formed there between for allowing flow of ambient fluid through said turbulator interior channel for increasing heat transfer of the liquid coolant flowing through said liquid coolant tube and around said turbulator elongated body portion; and a solid bar having a wing-shaped cross-section for directing turbulent wakes of the liquid coolant in a predetermined direction for increasing heat transfer without substantially increasing pressure drop of the liquid coolant above an identical at least one liquid coolant tube lacking said turbulators.

39. The keel cooler assembly of claim 38, wherein said turbulator elongated body portion being configured as a solid bar having a wing-shaped cross-section comprises a leading head portion, an intermediate portion having a concave surface, and a trailing tail portion;

said respective solid bars with said respective concave surfaces being arranged in a predetermined staggered pattern, said respective solid bars being with said respective turbulator intermediate portions being arranged in an alternating pattern, wherein said concave surface of respective longitudinally adjacent turbulators in the same longitudinal row face generally opposite directions.

40. The keel cooler assembly of claim 39, wherein said respective wing-shaped turbulators are rotatably arranged in a predetermined pattern for effecting said concave surface to generally face at least one of (i) an upstream bulk liquid coolant flow and (ii) a downstream bulk liquid coolant flow.

41. The keel cooler assembly of claim 30, wherein:

said header comprises an upper wall, an end wall, a bottom wall, opposing sidewalls, and an inclined surface operatively connecting said upper wall, bottom wall and sidewalls; and said at least one liquid coolant tube comprises an outer liquid coolant tube, said first sidewall being an interior sidewall and said second sidewall being an outermost sidewall;

wherein said outermost sidewalls extend between the side portions of said header upper wall and said header lower wall for forming said header sidewalls, and wherein said interior sidewalls separate a header chamber from said header sidewalls, said interior sidewalls having at least one inlet configured as an orifice located between said respective outermost sidewalls and said header chamber for allowing flow of the liquid coolant through said orifice and along said internal channel.

42. The keel cooler assembly of claim 30, wherein each of said plurality of turbulators includes a body portion extending inwardly into said internal channel from said liquid coolant tube elongated body portion interior surface, said body portion being disposed in a bulk region of the liquid coolant when the liquid coolant is flowing through said at least one liquid coolant tube for generating turbulent wakes in said bulk region for enhancing eddying motion and improving heat transfer without substantially increasing pressure drop of the liquid coolant above an identical at least one liquid coolant tube lacking said turbulators.

43. The keel cooler assembly according to claim 42, wherein said respective turbulator body portions extend from one of said respective upper wall, lower wall, first sidewall, and second sidewall to a different one of said upper wall, lower wall, first sidewall and second sidewall.

44. The keel cooler assembly according to claim 42, wherein the respective adjacent walls of said at least one liquid coolant tube meet at liquid coolant tube wall intersections, and wherein said respective turbulator body portions extend from a selected one of said respective upper wall, lower wall, first sidewall, second sidewall and liquid coolant wall intersections, to a different upper wall, lower wall, first sidewall, second sidewall and liquid coolant tube wall intersection.

45. The keel cooler assembly of claim 42, wherein said respective turbulator body portions comprise elongated body portions, said elongated body portions being arranged substantially orthogonal to at least one of said respective opposing walls.

46. The keel cooler assembly of claim 42, wherein each of said plurality of turbulators includes an elongated body portion having a cross-sectional configuration selected from the group consisting of: round, ellipsoid, oval, rectangular, square, triangular, wing-shaped, airfoil-shaped, polygonal, and irregular.

47. The keel cooler assembly of claim 46, wherein said plurality of turbulators is a first plurality of turbulators, and said turbulators in said at least one liquid coolant tube comprise a second plurality of turbulators having a different cross-sectional configuration than said first plurality of turbulators.

48. The keel cooler assembly of claim 29, wherein said turbulators are operatively connected to said at least one liquid coolant tube elongated body portion interior surface by at least one of brazing, soldering, welding, and integrally forming.

49. A liquid coolant tube for use in a keel cooler, said liquid coolant tube exchanging heat with an internal liquid coolant flowing through said liquid coolant tube, said liquid coolant tube extending in a longitudinal direction from a header, the header including an upper wall, an end wall, a bottom wall, opposing sidewalls, and an inclined surface operatively connecting said upper wall, bottom wall and sidewalls, said liquid coolant tube comprising:

an elongated body portion, said elongated body portion being configured as a rectangular parallelepiped and comprising:

an interior surface forming an internal channel for allowing flow of the liquid coolant in a longitudinal direction along a length of said elongated body portion;

opposing upper and lower walls, and opposing first and second sidewalls transverse to said opposing upper and lower walls, said first and second sidewalls operatively connecting said upper and lower walls for forming said internal channel; said elongated body portion having a rectangular cross-sectional configuration; and a plurality of turbulators extending inwardly into said internal channel from said elongated body portion interior surface and being configured to interact with the liquid coolant for enhancing the turbulence of the liquid coolant without substantially increasing pressure drop of the liquid coolant above an identical at least one liquid coolant tube lacking said turbulators.

50. The liquid coolant tube of claim 49, wherein each of said plurality of turbulators comprises an elongated body portion extending between at least one of (i) said opposing first and second sidewalls and (ii) said opposing upper and lower walls, said respective turbulator elongated body portions having opposing end portions being operatively connected to each of said respective opposing walls.

51. The liquid coolant tube of claim 50, wherein said plurality of turbulators are arranged in a predetermined pattern, said predetermined pattern comprising a plurality of longitudinal rows of said turbulators, said plurality of longitudinal rows of said turbulators including a first longitudinal spacing ($X_L$) between respective longitudinally adjacent turbulence enhancers located in the same longitudinal row, and a second transverse spacing ($X_H$) between respective transversely adjacent turbulence enhancers located in adjacent longitudinal rows.

52. The liquid coolant tube of claim 51, wherein said respective longitudinally adjacent turbulators located in the same longitudinal rows are transversely offset in an alternating staggered configuration.

53. The liquid coolant tube of claim 52, wherein said respective turbulator elongated body portions are configured as at least one of:

a solid cylinder having a round cross-section for enhancing the turbulence of the liquid coolant for improving heat transfer without substantially increasing pressure drop above an identical at least one liquid coolant tube lacking said turbulators;

a hollow cylinder having a round cross-section, said hollow cylinder having round openings on said opposing end portions with an interior channel formed there between for allowing flow of ambient liquid through said turbulator interior channel for increasing heat transfer of the liquid coolant flowing through said liquid coolant tube and around said turbulator elongated body portion; and a solid bar having a wing-shaped cross-section for directing turbulent wakes of the liquid coolant in a predetermined direction for increasing heat transfer without substantially increasing pressure drop of the liquid coolant above an identical at least one liquid coolant tube lacking said turbulators.

54. The liquid coolant tube of claim 53, wherein a spacing ratio (β) of said first longitudinal spacing ($X_L$) to said second transverse spacing ($X_H$) is in the range between about 1.0 and 7.0 for generating turbulent wakes in the liquid coolant for enhancing eddying motion and improving heat transfer without substantially increasing pressure drop of the liquid coolant above an identical at least one liquid coolant tube lacking said turbulators.

55. The liquid coolant tube of claim 53, wherein a spacing ratio (β) of said first longitudinal spacing ($X_L$) to said second transverse spacing ($X_H$) is greater than about 3.5 for generating and propagating turbulent vortexes in the liquid coolant for enhancing liquid coolant mixing and improving heat transfer without substantially increasing pressure drop of the liquid coolant above an identical at least one liquid coolant tube lacking said turbulators.

56. The liquid coolant tube of claim 53, wherein said turbulator elongated body portion being configured as a solid bar having a wing-shaped cross-section comprises a leading head portion, an intermediate portion having a concave surface, and a trailing tail portion;

said respective solid bars with said respective concave surfaces being arranged in a predetermined staggered pattern, said respective solid bars being with said respective turbulator intermediate portions being arranged in an alternating pattern, wherein said concave surface of respective longitudinally adjacent turbulators in the same longitudinal row face generally opposite directions.

57. The liquid coolant tube of claim 49, wherein said at least one liquid coolant tube comprises an inner liquid coolant tube, said elongated body portion including at least one open end portion having a rectangular cross-sectional configuration, said at least one open end portion defining at least one inlet for ingress of the liquid coolant, said at least one inlet being received by at least one spacing in the inclined surface of the header.

58. The liquid coolant tube of claim 49, wherein said at least one liquid coolant tube comprises an outer liquid coolant tube, said first sidewall being an interior sidewall and said second sidewall being an outermost sidewall;

wherein said outermost sidewalls extend between the side portions of the header upper wall and the header lower wall for forming the header sidewalls, and wherein said interior sidewalls separate a header chamber from the header sidewalls, said interior sidewalls having at least one inlet configured as an orifice located between said respective outermost sidewalls and said header chamber for allowing flow of the liquid coolant through said orifice and along said internal channel.

59. The liquid coolant tube of claim 49 being constructed of a copper-nickel alloy, wherein said turbulators are operatively connected to said interior surface of said elongated body portion of at least one liquid coolant tube by at least one of the group consisting of brazing, soldering, welding, and integrally forming.

* * * * *